US006105315A

United States Patent [19]

Stoecklein et al.

[11] Patent Number: 6,105,315

[45] Date of Patent: Aug. 22, 2000

[54] MODULAR MAUSOLEUM AND CRYPT STRUCTURE AND METHODS OF CONSTRUCTING SAME

[76] Inventors: Walter J. Stoecklein, 293-B, R. D. #2, Rte. 910, Cheswick, Pa. 15024; John C. Campbell, II, 518 Rodgers Dr., Pittsburgh, Pa. 15238

[21] Appl. No.: 09/122,292

[22] Filed: Jul. 24, 1998

[51] Int. Cl.[7] ..... E04H 13/00

[52] U.S. Cl. ..... 52/134; 52/131; 52/136; 52/142; 52/36.4; 52/439; 52/745.01; 27/1

[58] Field of Search ..... 52/128, 131, 134, 52/136, 137, 140, 142, 36.4, 36.5, 439, 745.01, 741.12; 27/1

[56] References Cited

U.S. PATENT DOCUMENTS

| | | | |
|---|---|---|---|
| 1,030,385 | 6/1912 | Clarkson . | |
| 2,235,185 | 3/1941 | Wiley | 52/136 X |
| 3,295,271 | 1/1967 | Dorris | 52/741.12 X |
| 3,564,796 | 2/1971 | Smith . | |
| 3,570,418 | 3/1971 | Edward et al. . | |
| 3,596,419 | 8/1971 | Jalbert | 52/137 |
| 3,945,094 | 3/1976 | Daran et al. | 52/134 X |
| 3,968,601 | 7/1976 | Brown et al. . | |
| 4,099,353 | 7/1978 | Blunt . | |
| 4,557,091 | 12/1985 | Auer | 52/282 |
| 4,648,219 | 3/1987 | Johnston, Sr. | 52/136 X |
| 4,777,774 | 10/1988 | Smalley, III | 52/282 |
| 5,010,697 | 4/1991 | Schwarten . | |
| 5,076,151 | 12/1991 | Carrier | 52/134 X |
| 5,243,794 | 9/1993 | Pikor . | |
| 5,245,733 | 9/1993 | Goria | 27/35 |
| 5,245,803 | 9/1993 | Haag . | |
| 5,408,787 | 4/1995 | Barnett . | |
| 5,511,345 | 4/1996 | Jones et al. . | |
| 5,553,430 | 9/1996 | Majnaric et al. | 52/236.8 |
| 5,611,125 | 3/1997 | Williams et al. | 27/3 |
| 5,636,481 | 6/1997 | De Zen . | |
| 5,706,620 | 1/1998 | De Zen . | |
| 5,729,944 | 3/1998 | De Zen . | |
| 5,735,090 | 4/1998 | Papke | 52/439 X |
| 5,899,045 | 5/1999 | Giannarelli | 52/134 X |

FOREIGN PATENT DOCUMENTS

| | | | |
|---|---|---|---|
| 634724 | 2/1928 | France | 52/137 |
| 1453984 | 9/1966 | France . | |
| 197806 | 6/1978 | France . | |
| 2551793 | 3/1985 | France | 52/136 |
| 744431 | 4/1993 | France | 52/137 |
| 808070 | 4/1951 | Germany . | |

OTHER PUBLICATIONS

Royal Building Systems (CDN) Limited, *Introducing the Evolution of The Royal Housing System*, 1994, Woodbridge, Ontario, Canada.

*Primary Examiner*—Laura A. Callo
*Attorney, Agent, or Firm*—Kirkpatrick & Lockhart LLP

[57] ABSTRACT

A mausoleum and method of constructing a mausoleum. The mausoleum may include plurality of vertically extending walls supportable on a surface, wherein at least one vertically extending wall has a plurality of cells integrally formed therein. At least one cell is substantially filled with a filler material. A roof is supported on the vertically extending walls and cooperates with those walls to define at least one crypt niche having at least one open end. A closure panel corresponding to each open end of each crypt niche is provided. One or more cells within the walls may be unfilled to serve as drain and/or vent passages for each niche. Shelf assemblies may be supported within each niche to form chambers for receiving caskets therein. Each shelf may have open cells formed therein which can communicate with open cells within the walls. A lawn crypt manufactured from similar materials is also disclosed.

62 Claims, 17 Drawing Sheets

MODULAR MAUSOLEUM AND CRYPT STRUCTURE AND METHODS OF CONSTRUCTING SAME

CROSS-REFERENCE TO RELATED APPLICATIONS

Not applicable.

FEDERALLY SPONSORED RESEARCH

Not applicable.

BACKGROUND OF THE INVENTION

1. Field of the Invention

The subject invention relates to mausoleums and crypt structures and, more particularly, to mausoleums and lawn crypts constructed from interconnectable wall assemblies.

2. Description of the Invention Background

Mausoleums are aboveground structures that provide a plurality of vaults or chambers for entombment of corpses. A burial casket, usually constructed of wood, is typically inserted through an opening in one wall of the mausoleum into a chamber and the chamber is sealed with a cover arrangement. The cover usually comprises a marble face or granite plate that bears the name and dates of the deceased.

Below ground crypts, known as "lawn crypts", are constructed by excavating a pit in the earth and installing an arrangement of burial chambers therein. The burial chambers may be single tier or multi-tiered. Once the collection of burial chambers is constructed, each chamber is covered by a concrete lid and the lawn crypt is then covered with soil. When access to a particular burial chamber is desired, the soil is removed from atop a particular burial chamber to enable the lid to be removed. After the casket is placed into the chamber, the lid is replaced and the removed soil is pushed back into the excavation and leveled.

The construction of mausoleums and lawn crypts in the past has been an expensive and time consuming process. One method of constructing these structures involves the use of precasted concrete crypts that are formed off-site and trucked to the installation site. Depending upon the size of the crypts, large trucks may be required to transport those heavy structures. Such process may require that special transportation permits be secured before the walls can be transported to the site. Once at the site, large cranes or other similar equipment may be required to manipulate the walls into their proper orientation. Such installation process requires skilled labor and a substantial investment in heavy equipment.

Another method commonly employed to construct mausoleums and lawn crypts involves erecting forms, usually from wood, at the site and then pouring concrete into the forms to form the walls of the structure. Skilled labor is typically required to construct the appropriate forms, install the proper reinforcing members and then pour the concrete. When using this process to form a multilevel crypt or mausoleum, the forms for the first level are constructed and thereafter concrete is d therein. After the concrete has cured, the forms are removed from the walls and then re-erected at the top of the first level and the process is repeated for each level that is desired.

The reader will readily appreciate that such construction methods are time consuming and expensive. The skilled artisan will further appreciate that such methods must be carefully performed to ensure that adequate structural integrity is achieved. For example, excessive air pockets and voids in the concrete can compromise the structural integrity of the structure. Furthermore, concrete walls can have a rough texture if left uncovered which can tend to make them difficult to clean. In many aboveground installations, the concrete walls are covered with marble dressing materials to obviate such problems.

The manufacturers of mausoleums are also faced with other challenges. For example, overtime, caskets can deteriorate and emit body fluids and gases. Thus, to prevent perceptible leakage of odorous fluids and gasses from the mausoleum, each chamber must be provided with a vent and drainage system. In conventional construction methods, drain/vent pipes are installed within the wall forms and the concrete is then poured around them. Such installation process is time consuming. Furthermore, a drain/vent pipe is susceptible to becoming damaged during the pouring of the concrete. In severe cases, the pipe can snap rendering it useless for draining/venting purposes. In other installations, such pipes are supported along the wall exteriors.

After the drain pipes have been installed, passages are provided into the drain pipes from corresponding chambers. To prevent such fluids and gases from inadvertently leaking from a chamber, the chamber should be substantially "fluid-tight". Thus, the concrete walls must be held to relatively close tolerances to achieve fluid-tight seals between the walls and the chamber closure panels or lids. Often times, due to imperfections in the concrete pour, one or more chambers are not substantially fluid-tight. Thus, body gases and/or fluids can escape the chamber without passing through the drain/vent pipe. One method that has been employed to address such problem, involves placing each casket into a separate sealable bag or container. While such approach is somewhat effective for ensuring that body gases and fluids ultimately reach a drain/vent pipe, they add considerable expense to the entombment process.

Still more challenges typically face the personnel that place the caskets into the mausoleum. Most mausoleum chambers typically have one open end through which the casket must be inserted. To facilitate entry of the casket into the chamber, the casket must be slid on the concrete floor of the chamber. Such process is generally difficult and can result in inadvertent damage to the casket. One method that has been commonly employed to avoid that problem has been to place the casket on sections of round pipe which enable the casket to be "rolled" into the chamber. Such use of rollers is awkward and cumbersome.

Thus, there is a need for mausoleums and lawn crypts that are easy to construct and assemble without the need for a large skilled labor force.

There is a further need for mausoleums and lawn crypts that are economical to construct.

A need exists for mausoleums that have drainage and venting systems that are not susceptible to inadvertent damage during construction.

There is another need for materials for constructing mausoleums and lawn crypts that are easy to clean and maintain after installation.

Yet another need exists for construction materials for aboveground mausoleums that are aesthetically pleasing.

Still another need exists for a shelf arrangement for a mausoleum that facilitates easy inserting of a casket into a chamber without the use of rollers, etc.

Another need exists for a method of constructing mausoleums and lawn crypts wherein the use of reinforcement bars and similar materials is not necessarily required.

SUMMARY OF THE INVENTION

In accordance with particularly preferred forms of the present invention, there is provided a mausoleum that includes a plurality of vertically extending walls supportable on a surface, wherein at least one vertically extending wall has a plurality of cells integrally formed therein. At least one cell may be substantially filled with a filler material. A roof is supported on the walls to define at least one crypt niche having at least one open end. A closure panel corresponding to each open end of each crypt niche is provided. Each closure panel is attachable to the mausoleum to cover the open end of the corresponding crypt niche.

The present invention may also comprise a mausoleum that includes a base slab and at least two vertically extending walls supported on the base slab. At least one vertically extending wall has at least one substantially unobstructed cell integrally formed therein. The mausoleum also includes a roof member that is supported on the vertically extending walls to form at least one crypt niche having at least one open end. The mausoleum further includes at least one shelf member supported within each crypt niche to subdivide the crypt niche into a plurality of chambers wherein each chamber has an open end. Each shelf has at least one drain conduit communicating with at least one unobstructed cell in at least one vertically extending wall. A closure panel corresponding to each open end of each chamber may be attached to the mausoleum to enclose the corresponding open end.

The present invention may also comprise a shelf assembly for a crypt niche. The shelf assembly includes a support frame that is attachable to at least one niche wall and a shelf that is supportable on the support frame. The shelf may have a plurality of open cells formed therein, wherein at least one open cell is constructed to communicate with at least one passage in at least one niche wall.

The present invention may also include a lawn crypt that includes a base member and a plurality of vertically extending walls attached to the base member and interlocked together at their respective ends to form at least one crypt niche. At least one vertically extending wall has a plurality of cells integrally formed therein. At least one cell may be substantially filled with a filler material. The lawn crypt may also include a removable lid that is supported on the vertical walls to cover at least one crypt niche.

In accordance with the present invention there is also provided a method of constructing a mausoleum. The method may include the actions of constructing a base and supporting at least two upstanding walls on the base, wherein at least one upstanding wall has a plurality of open cells integrally formed therein. The method may further include the action of substantially filling at least one open cell in each upstanding wall having open cells therein with a filler material. The method may also include supporting a roof on the upstanding walls to form a crypt niche having an interior and at least one open end and enclosing each open end with a removable closure panel to substantially enclose the crypt niche.

The subject invention may also include a method of constructing a lawn crypt that includes the actions of excavating a cavity in the earth and constructing a concrete support base within the cavity. The method may also comprise supporting at least two lateral walls on the concrete support base in spaced-apart relation to each other, wherein at least one lateral wall has a plurality of open cells substantially extending the length thereof and wherein each lateral wall has first and second ends. Another action of the present invention may include supporting a first end wall on the support base adjacent the first ends of the lateral walls and attaching the first end wall to the first ends of the lateral walls. The present invention may also include supporting a second end wall adjacent the second ends of the lateral walls and attaching the second end wall to the second ends of the lateral walls such that the lateral walls and the first and second end walls define at least one crypt niche therebetween.

It is a feature of the present invention to provide mausoleum and lawn crypt structures that are attractive, functional and less expensive to construct than prior mausoleum and lawn crypt structures.

It is another feature of the present invention to provide mausoleum and lawn crypt structures and methods for constructing such structures that do not require the amounts of skilled labor that are commonly associated with constructing prior mausoleums and lawn crypts.

Another feature of the present invention is to provide a unique method of venting and draining individual chambers within a mausoleum that reduce the likelihood of damage to the venting structures during installation.

Yet another feature of the present invention is to provide a unique shelf assembly for use in mausoleums and/or lawn crypts that has open cells therein which can facilitate draining and venting of a chamber in which the shelf is supported.

Another feature of the present invention is to provide a shelf that facilitates the admission of a casket into a chamber without the use of ancillary roller devices, etc.

Still another feature of the present invention is to provide methods of constructing mausoleums and lawn crypts where the form structures are retained and comprise the wall exteriors.

Accordingly, the present invention provides solutions to the shortcomings of prior mausoleums and lawn crypts and the methods of constructing those structures. Those of ordinary skill in the art will readily appreciate, however, that these and other details, features and advantages will become further apparent as the following detailed description of the preferred embodiments proceeds

BRIEF DESCRIPTION OF THE DRAWINGS

In the accompanying Figures, there are shown present preferred embodiments of the invention wherein like reference numerals are employed to designate like parts and wherein.

DETAILED DESCRIPTION OF THE PREFERRED EMBODIMENTS

Figure 1:
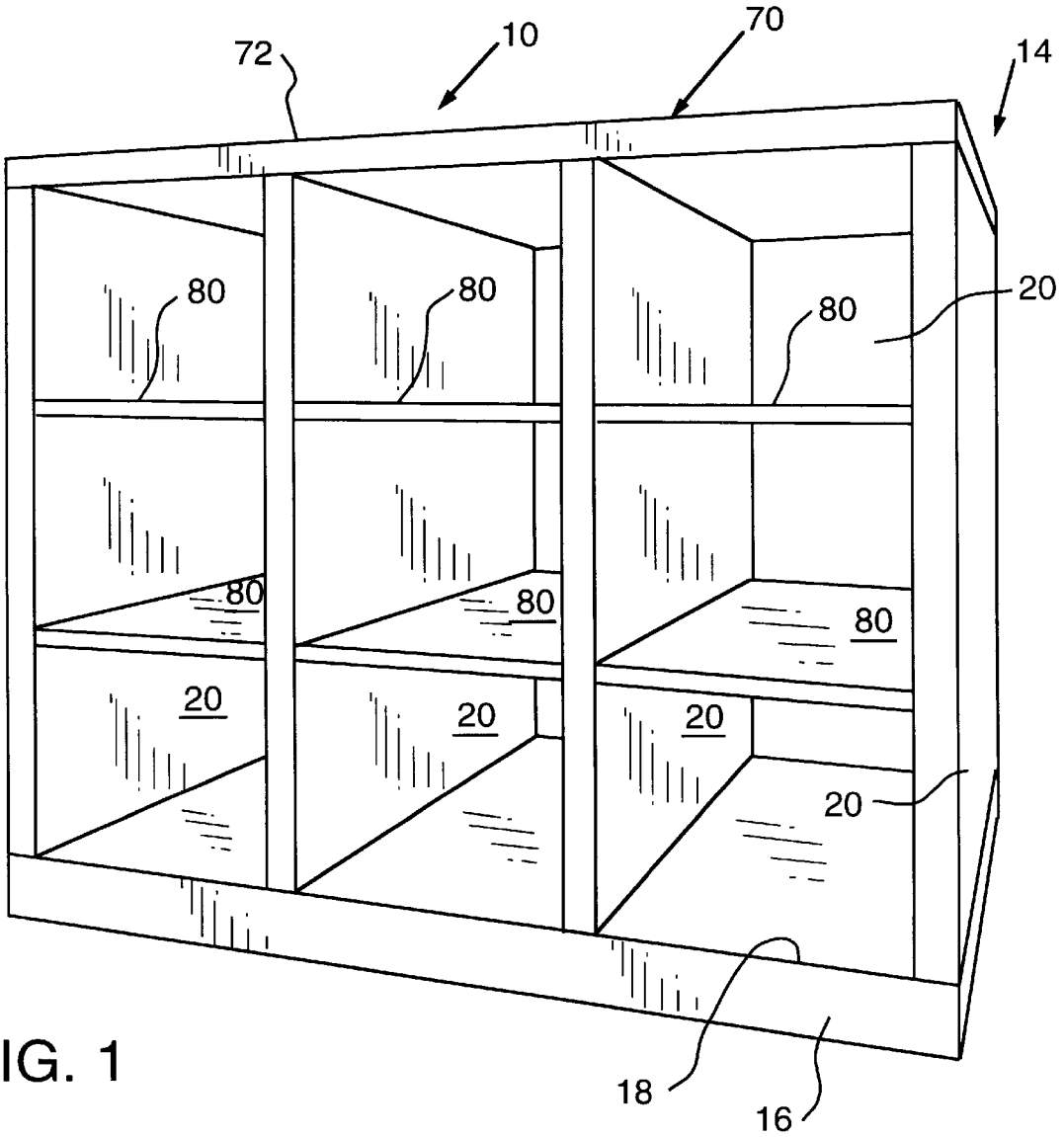
FIG. 1 is a perspective view of a mausoleum of the present invention with the closure panels thereof removed.
Figure 2:
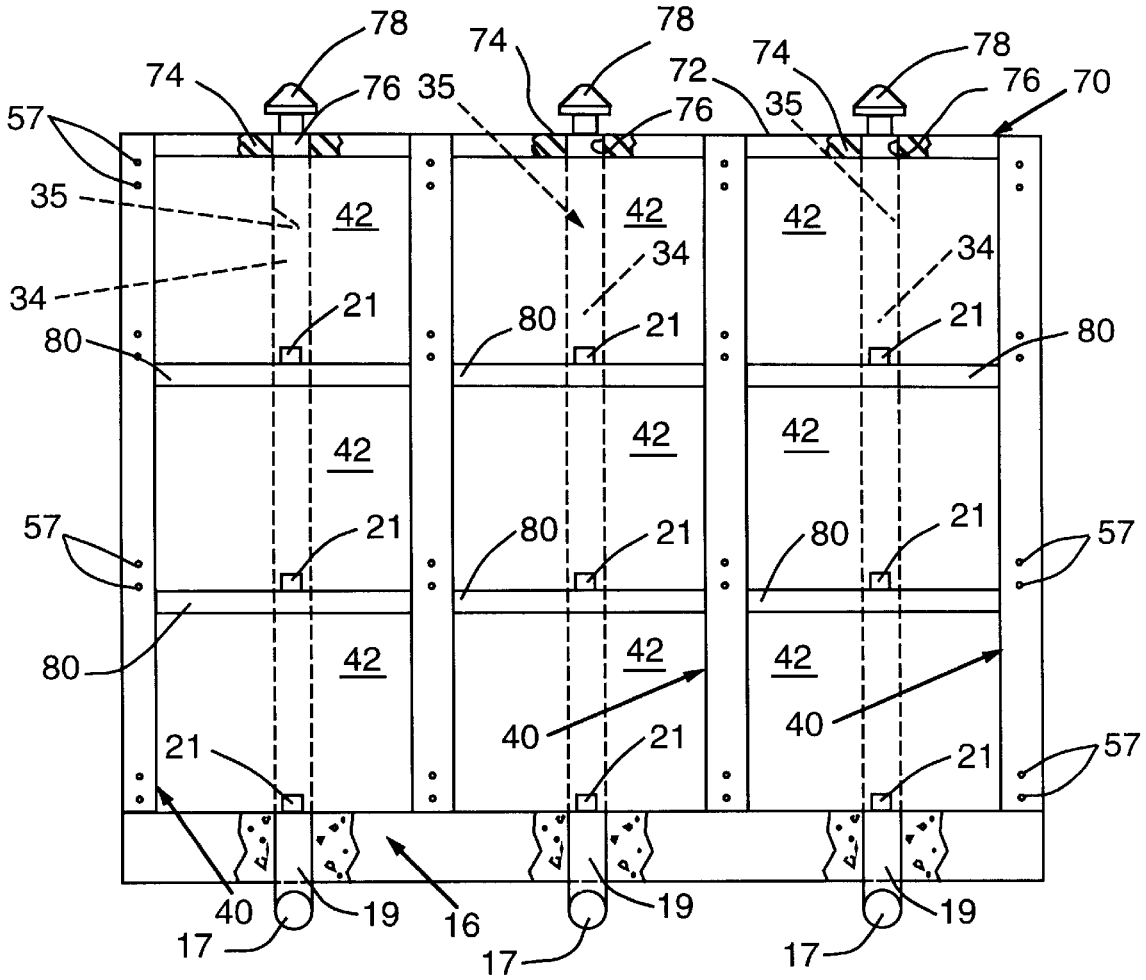
FIG. 2 is an end elevational view of the mausoleum of FIG. 1.
Figure 3:
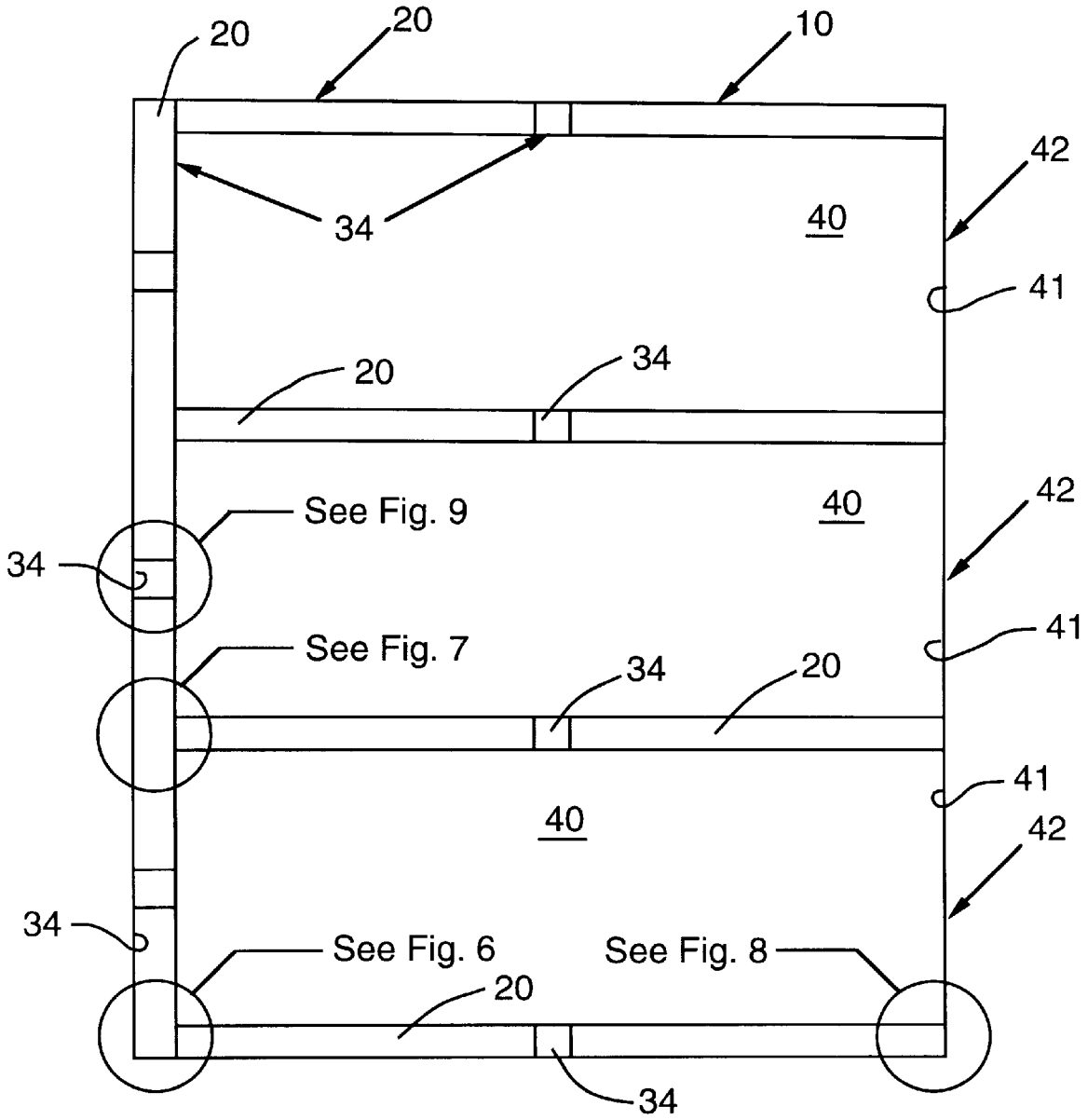
FIG. 3 is a plan view of the mausoleum of FIGS. 1 and 2.

Referring now to the drawings for the purposes of illustrating the present preferred embodiments of the invention only and not for the purposes of limiting the same, FIGS. 1–3 depict an aboveground crypt arrangement or mausoleum 10 constructed according to the present invention. As can be seen in FIGS. 1 and 2, the mausoleum 10 comprises an aboveground wall assembly 14 that is supported on a base 16 that has a support surface 18. Base 16 may comprise a reinforced concrete slab that is constructed using conventional techniques and materials.

In the mausoleum 10 depicted in FIGS. 1–3, five upstanding lateral wall assemblies 20 are supported on the base 16 to define three, side-by-side open ended niches 40 that each have an open end 41. Two shelf assemblies 80 are supported within each niche 40 to define a 3×3 array of nine chambers 42. See FIG. 2. The construction and installation of the shelf assemblies 80 will be discussed in further detail below.

Figure 4:
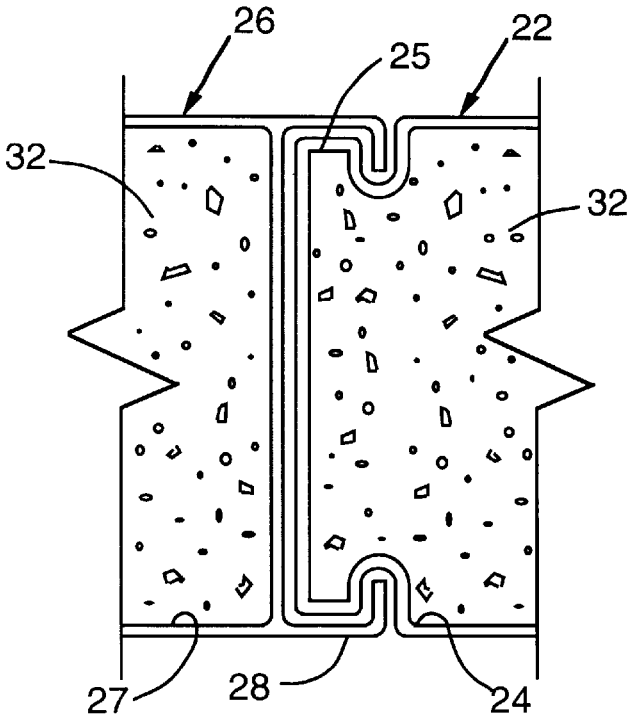
FIG. 4 is an enlarged view of an interlocking joint between a preferred wall panel and a connector panel of the present invention.
Figure 5:
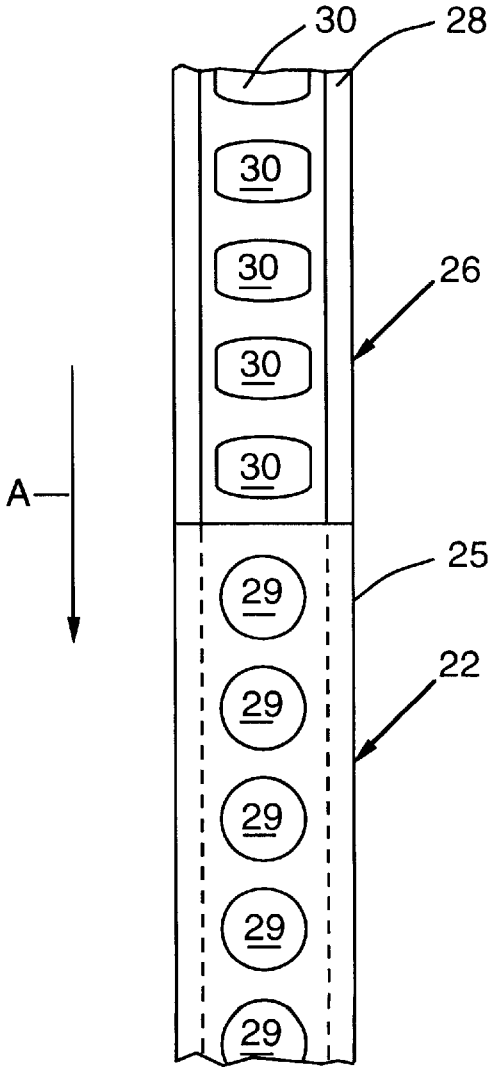
FIG. 5 is a partial assembly view of a wall panel slidably engaging a corresponding connector panel.

The walls 20 of the wall assembly 14 may comprise the wall components manufactured by Royal Building Systems (CDN) Limited of 1 Royal Gate Blvd., Woodbridge, Ontario, Canada L4L8Z7 or similarly constructed components. Walls 20 may be each fabricated from a plurality of wall panels 22 that are slidably interlocked together by connector panels 26 that are similarly fabricated. Each panel (22, 26) is preferably fabricated from a polymeric material such as vinyl and has two exterior surfaces that may be cast with a desired texture that facilitates easy cleaning thereof. It will be further appreciated that such wall panels (22, 26) may be fabricated in a variety of different colors. Each wall panel 22 may have a plurality of open cells 24 integrally formed therein that extend substantially the entire length of the panel 22. A first T-shaped connector 25 is preferably formed along each lateral end of each panel 22 as shown in FIG. 4. Wall panels 22 may be interconnected by connector panels 26 that are also preferably fabricated from a polymeric material such as vinyl or the like. Each connector panel 26 may also define an open cell 27 and has a C-shaped connector portion 28 on each lateral side thereof. Each C-shaped connector portion 28 is adapted to slidably receive therein a corresponding T-shaped connector 25 of an adjacent wall panel 22. In a preferred embodiment, the T-shaped connector portions 25 each have a plurality of baffle openings 29 therethrough that correspond with similar baffle openings 30 in the connector panel 26 to permit a filler material 32, such as concrete to extend between the wall panel 22 and the connector 26. Such baffle/filler material arrangement can serve to strengthen the wall and eliminate the need to use reinforcing bars and the like.

In this embodiment, to provide at least one vent/drain passage into each chamber 42, at least one open cell (24, 27) which corresponds to each niche 40 may not be filled with the filler material 32 and therefore is open to form a drain/vent passage (designated as 34) for that niche. As the detailed description proceeds, those of ordinary skill in the art will appreciate that by attaching each cell (24, 27) forming a passage 34 to drain and by permitting such cells to be vented to atmosphere, one passage 34 can function as both a drain and a vent. If desired, however, such passages 34 may also be provided in the other walls 20 such that the passages 34 in the wall 20 forming the closed end of the mausoleum function as drain passages and the passages 34 in the other walls 20 function as vent passages.

Figure 6:
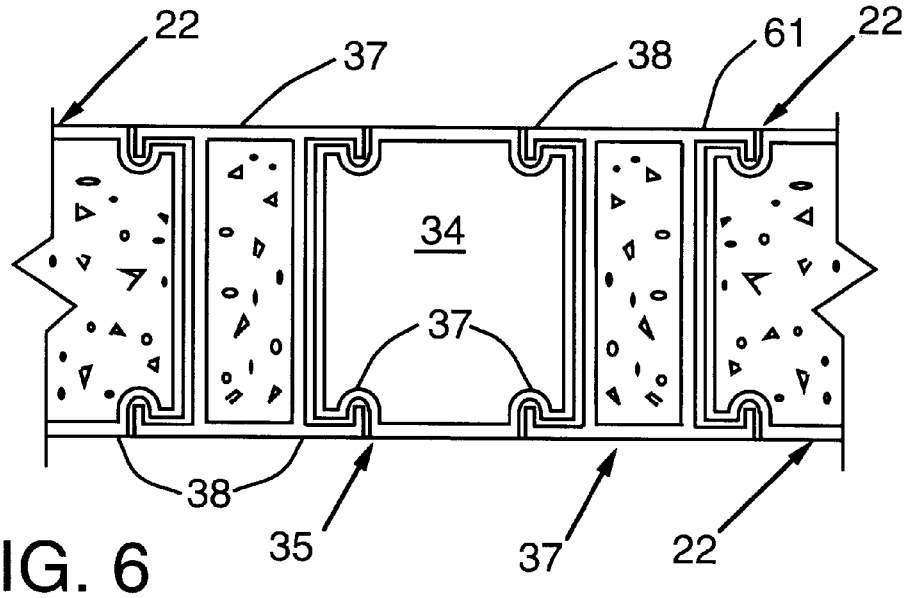
FIG. 6 is a partial cross-sectional plan view of an open cell panel and straight box connectors that can be integrally connected within a wall to form a drain/vent passage therethrough.

When using cells (24,27) to form vent/drain passages 34 and when adjacent cells in the wall panels 22 are filled with a filler material, the filler material could inadvertently pass through the baffle openings (29, 30) in the adjacent panels and into the cells (24, 27) intended to form passageways 34. Thus, an open cell panel 35, that has no baffle openings therein is preferably employed. The open cell panel 35 may be interconnected to adjacent wall panels 22 by two short connector panels 37. As can be seen in FIG. 6, an open cell panel 35 and two straight box connectors 37 are affixed to adjoining wall panels 22. In particular, the open cell panel 35 has two T-shaped connector portions 36 and each box connector 37 has two C-shaped connector portions 38. The connector portions 38 enable the open cell panel 35 to be slidably interconnected with the ends of corresponding wall panels 22. The open cell panel 35 may comprise the panel manufactured by Royal Building Systems under model no. GEP093HA:TN and the box connectors 37 may each comprise those connectors manufactured by that entity under model no. GEB2C45HA. To assemble a wall 20, the appropriate number of wall panels 22, connector panels 26, open cell panels 35, and box connectors 37 are selected to achieve the desired wall size. Thereafter, those elements are slidably fastened together in the manner illustrated in FIG. 4. The C-shaped connector portion of one wall element is aligned with the T-shaped connector portion of an adjacent element and those elements are slid together as represented by arrow "A" in FIG. 4. Those of ordinary skill in the art will appreciate that by fabricating each wall 20 from a series of such lightweight elements, those elements can be shipped to the installation site and assembled into walls 20. However, it will be further appreciated that one or more of the walls 20 may be provided as a single, unitary unit with open cells integrally formed therein.

After the walls 20 have been assembled, they are each arranged on the base 16 as shown in FIGS. 1–3. The skilled artisan will readily appreciate that such polymeric walls 20, due to their lightweight composition, are relatively easy to stand on end on the base 16, when compared to precast concrete walls. After, a wall 20 is placed on end, at least one cell 24 and/or cell 27 is filled with a filler material such as concrete (designated as 32 throughout the Figures herein). To achieve an interlocked joint between a wall panel 22 and connection panel 26, the cell 24 of the wall panel 22 adjacent the connector panel 26 and the cell 27 in the connector panel are each preferably filled with a filler material 32 such as concrete. As the filler material 32 is poured into the cells (24, 27), each cell expands slightly which causes the adjoining connector portions (25, 28) to interlock with each other, establishing a substantially fluid-tight joint between the adjoining panel 22 and the connector panel 26. If desired, the filler material 32 can be pumped into the cells (24, 27) prior to supporting the wall 20 on the base 16. Then, after the filler material 32 has cured (if necessary), the wall 20 can thereafter be placed onto the base 16. Preferably, the walls 20 are rigidly affixed to the base 16 by conventional fastening techniques.

Figure 7:
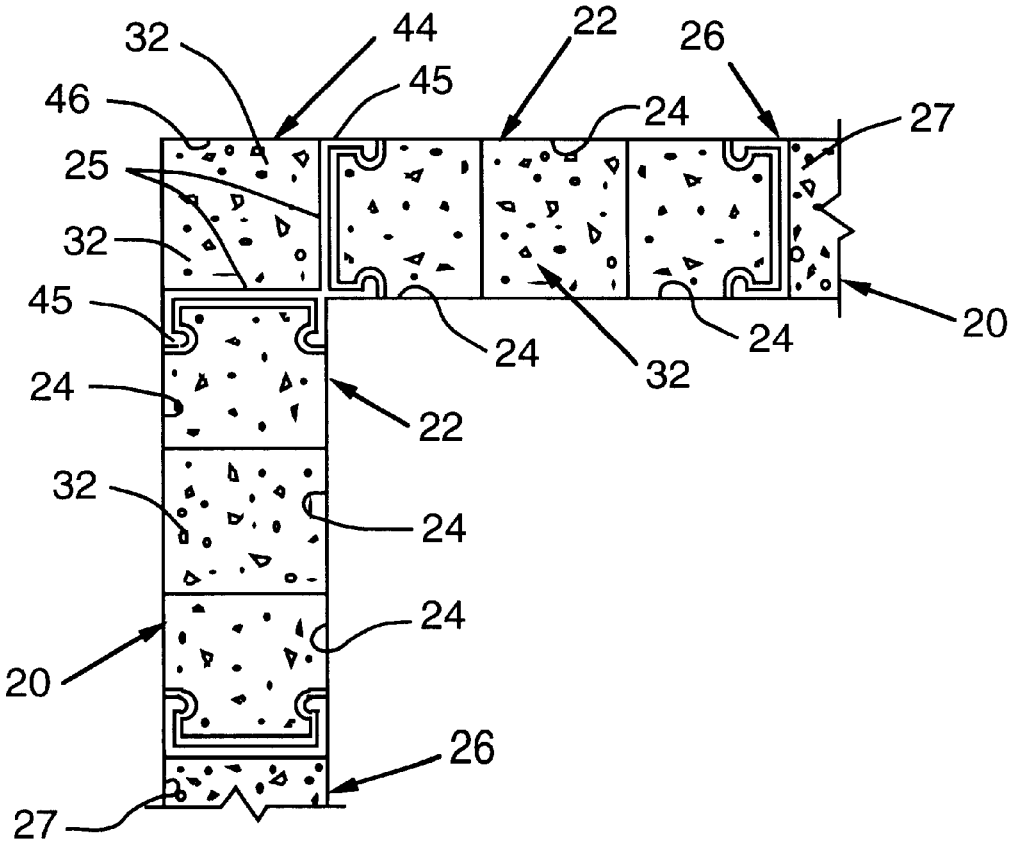
FIG. 7 is a partial cross-sectional plan view of a corner connector panel interlocking two walls at right angles to each other to form a rear corner of the mausoleum of FIG. 1.
Figure 8:
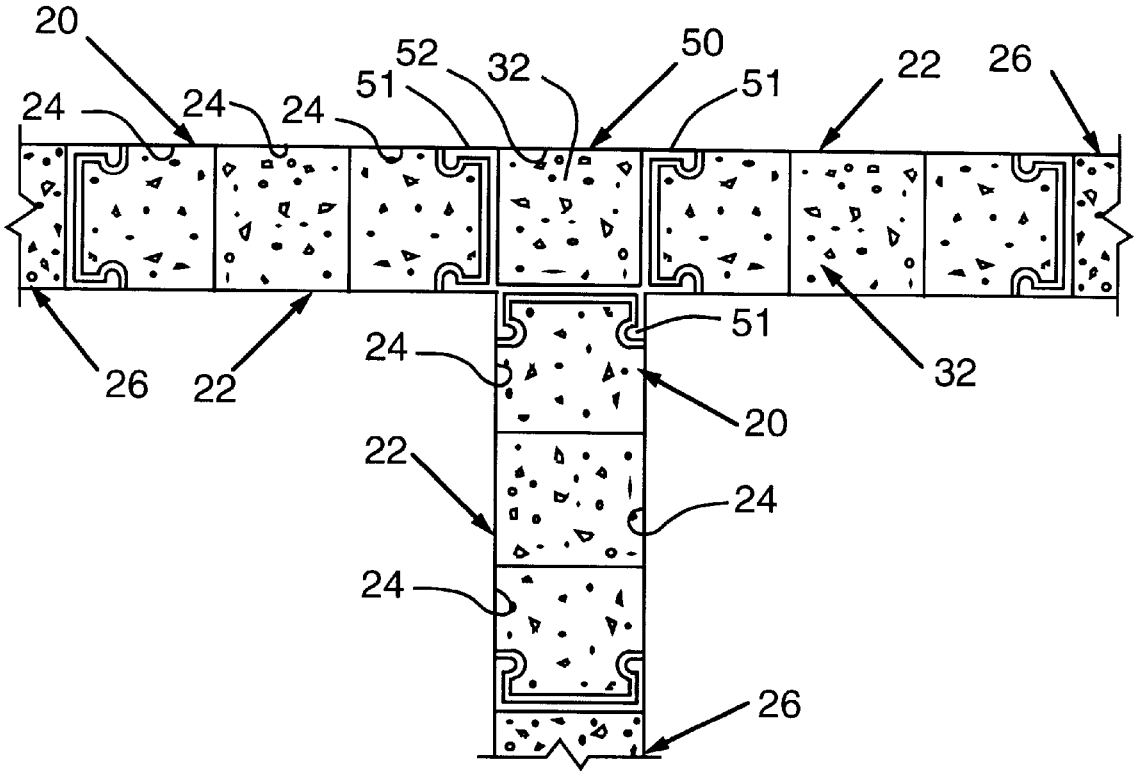
FIG. 8 is a partial cross-sectional plan view of a three-way connector panel interconnecting three wall panels that form walls of the mausoleum of FIG. 1.
Figure 9:
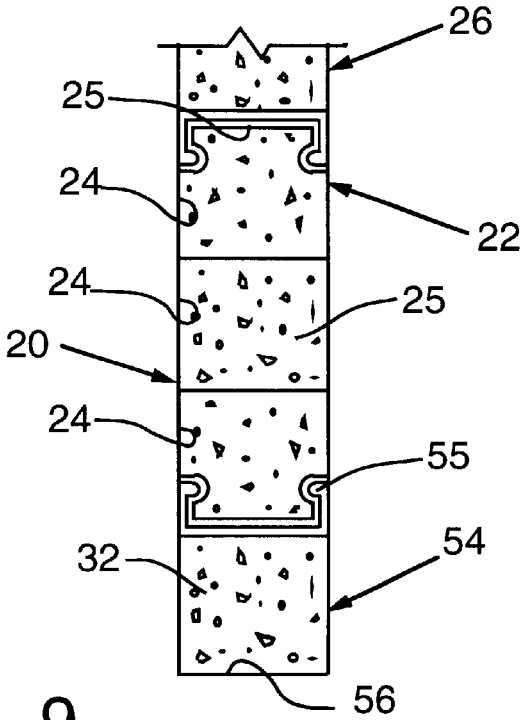
FIG. 9 is a partial cross-sectional plan view of a front end of a wall of the mausoleum of FIG. 1 with an end connector attached thereto.

FIGS. 7–9 illustrate various wall panel components that may be employed to complete the wall assembly 14. FIG. 7 is a partial plan view of a connection arrangement between two walls 20 wherein one wall 20 forms an end of the mausoleum 10. As can be seen in that Figure, after the two walls 20 have been assembled, they are supported on the base 16 in the illustrated orientation. Thereafter, a hollow corner panel 44, having two C-shaped connector portions 45 arranged at right angles to each other are slidably interconnected with the corresponding T-shaped connector portions 25 of the adjoining wall panels 20. Corner panel 44 may also define an open cell 46. After the corner panel 44 has been installed, it is preferably filled with a filler material 32 such as concrete. Panels 22 may each comprise the wall panel manufactured by Royal Building Systems under model No. GEP232HATN1660F and the corner panel 44 may comprise the corner member also manufactured by Royal Building Systems under model no. GEBCCWHATN1660F.

FIG. 8 is a partial plan view depicting a connection arrangement between the wall 20 forming the end of the mausoleum 10 and one of the internal walls 20. As can be seen in that Figure, a three-way connector panel 50 is connected between the wall 20 and the adjoining interior lateral wall 20. Three-way connector panel 50 may comprise the three-way connector panel manufactured by Royal Building Systems under model no. GEBCTNHATN. The connector panel 50 has three C-shaped connector portions 51 that slidably engage the corresponding T-shaped connector portions 25 of the corresponding adjacent wall panels 22 as shown in FIG. 8. Connector panel 50 may also define an open cell 52 that is thereafter preferably substantially filled with a filler material 32 such as concrete.

FIG. 9 is a partial plan view of an end panel 54 employed on an end of each wall 20 that cooperate to form the ends of the chambers 42. As can be seen in that Figure, an end panel 54 has a C-shaped connector portion 55 that is adapted to slidably engage a corresponding T-shaped connector 25 of the last wall panel 22 forming the wall 20. The end panel-54 also preferably defines an open cell 56 that is preferably filled with the filler material 32. As can be seen in FIG. 2, a series of mounting holes 57 may be provided in each end panel 54 to facilitate attachment thereto of conventional marble or granite slabs using conventional fastening techniques if so desired.

As shown in FIG. 2, a network of drain conduits 17 may be provided under the base 16 or adjacent to the base member 16. Each open cell (24, 27, 35) functioning as a drain passage 34 may communicate with a corresponding drain conduit 17 by a connector conduit 19 that extends through the base 16 and into the open cell (24, 27, 35), whichever the case may be. An opening or passage 21 is provided through the corresponding portion of wall 20 in each chamber 42 to enable the interior of each chamber 42 to vent or drain into a corresponding passage 34.

The mausoleum structure 10 also includes a roof structure 70. The skilled artisan will appreciate that the roof structure 70 may comprise a variety of known roof constructions and configurations. For example, roof trusses can be used in applications wherein a pitched roof is desired. In such application, wood plates can be attached to the top of the walls 20 by conventional fastener techniques for fastening wood to concrete. The trusses may then be attached to the wood plates. In the embodiment depicted in FIGS. 1–3, the roof structure 70 comprises a wall assembly 72 that is constructed in the same manner and out of similar materials as those materials comprising a wall 20. The wall assembly 72 may be placed onto the upstanding walls 20 prior to having some or all of its open cells (24, 27) filled with a filler material such as concrete. The roof structure 70 may then be attached to the upstanding walls 20 utilizing conventional fastening techniques such as concrete lag screws, etc. To facilitate venting of the open cells forming vent passages 34 that communicate with the chambers 42, a connector conduit 76 corresponding to each passage 34 extends through a hole 74 in the roof structure 70 and into the open cell 35 forming the passageway 34. A commercially available vent hood assembly 78 may be affixed to the connector conduit 86 to prevent the infiltration of water, etc. into the chambers 42.

Figure 10:
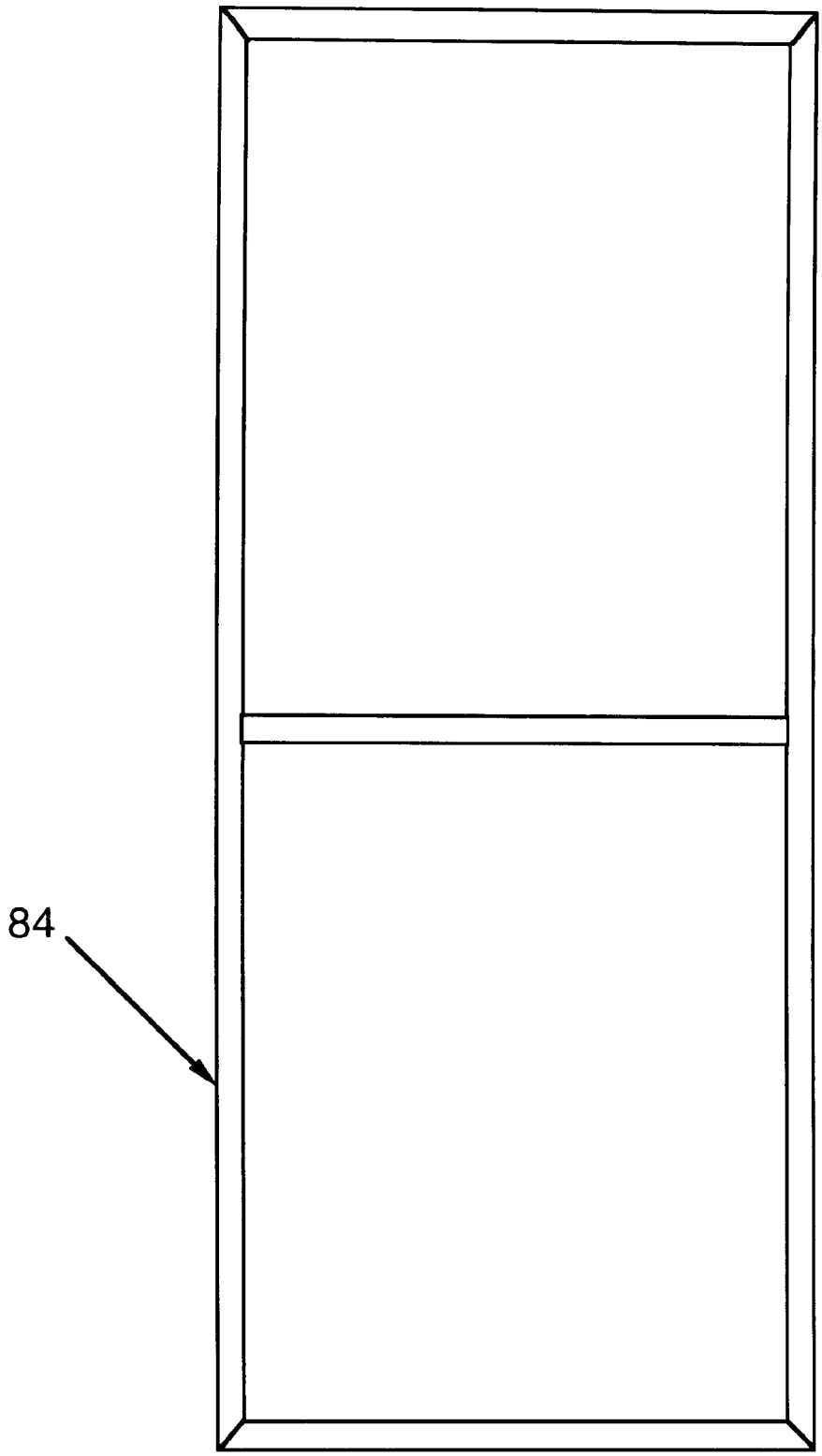
FIG. 10 is a plan view of a preferred frame assembly for supporting a shelf within a niche.

As shown in FIGS. 1 and 2, the niches 40 may be subdivided by shelf assemblies 80 supported therein. Each shelf assembly 80 may comprise a shelf 82 that is supported on a support frame 84 fabricated from, for example, steel, stainless steel, aluminum angles, etc. interconnected as shown in FIGS. 10. In a preferred embodiment, the support frame 84 is fabricated from a window casing material 84' such as that manufactured by Royal Building Systems under model no. TEKE38AAWU. See FIG. 11. The support frame 84 may be attached to the walls 20 by, for example, lag screws 85 that extend into the adjacent wall cells (24, 27) that have been filled with concrete. In a preferred embodiment, the shelf support frame (84, 84') is attached to the walls 20 such that it has a draft of approximately 1" from the forward end of the shelf assembly 80 to its rear end which is adjacent to the wall 20 forming the closed end of the mausoleum 10.

Figure 11:
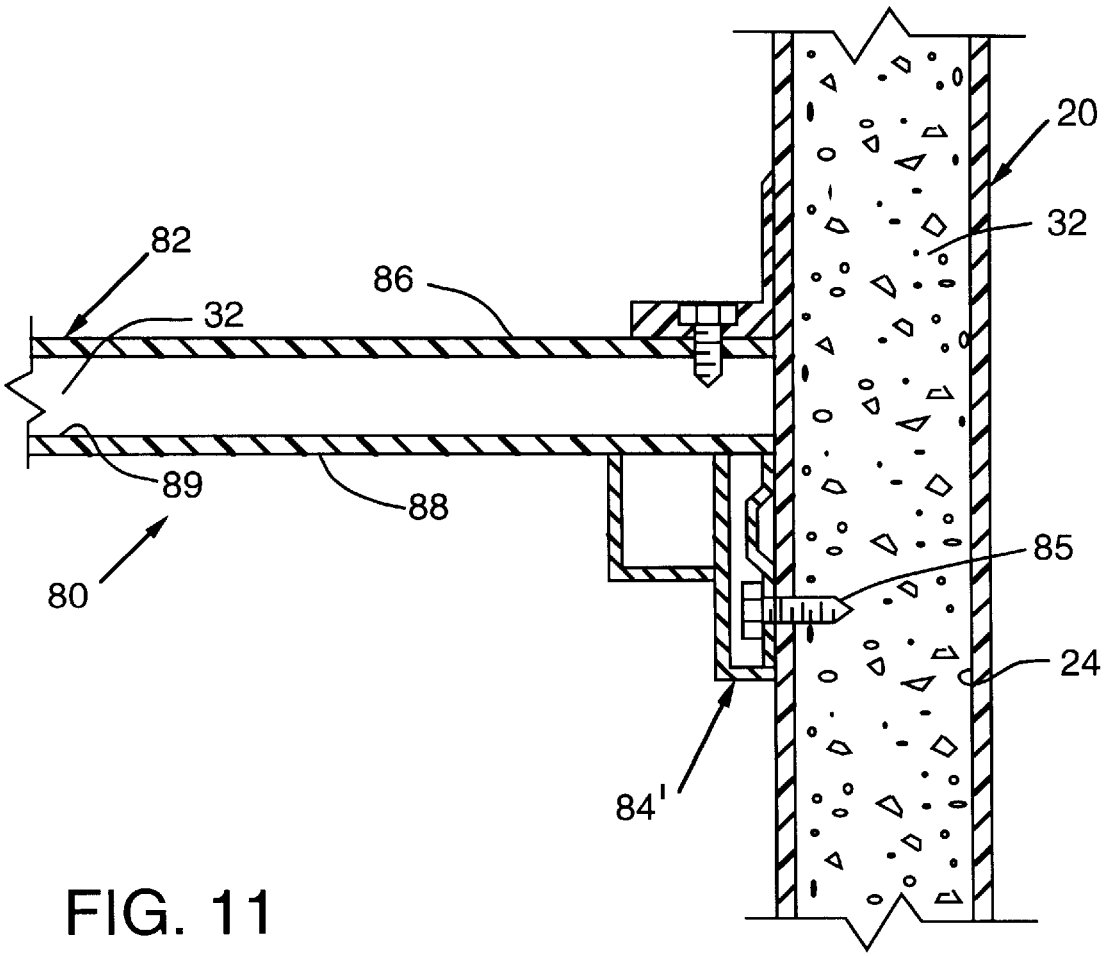
FIG. 11 is a partial cross-sectional elevational view showing a shelf attached to a wall of the mausoleum of FIG. 1.
Figure 12:
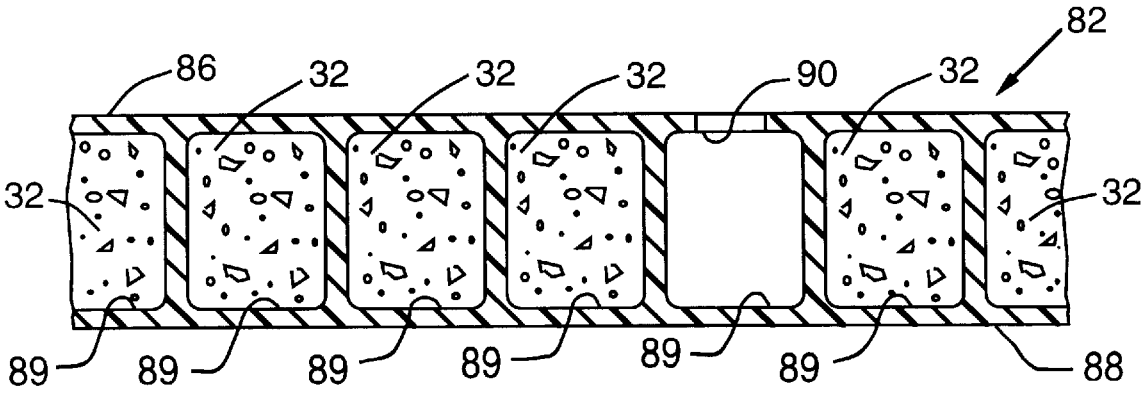
FIG. 12 is a partial cross-sectional view of a preferred wall sect on of the present invention.
Figure 13:
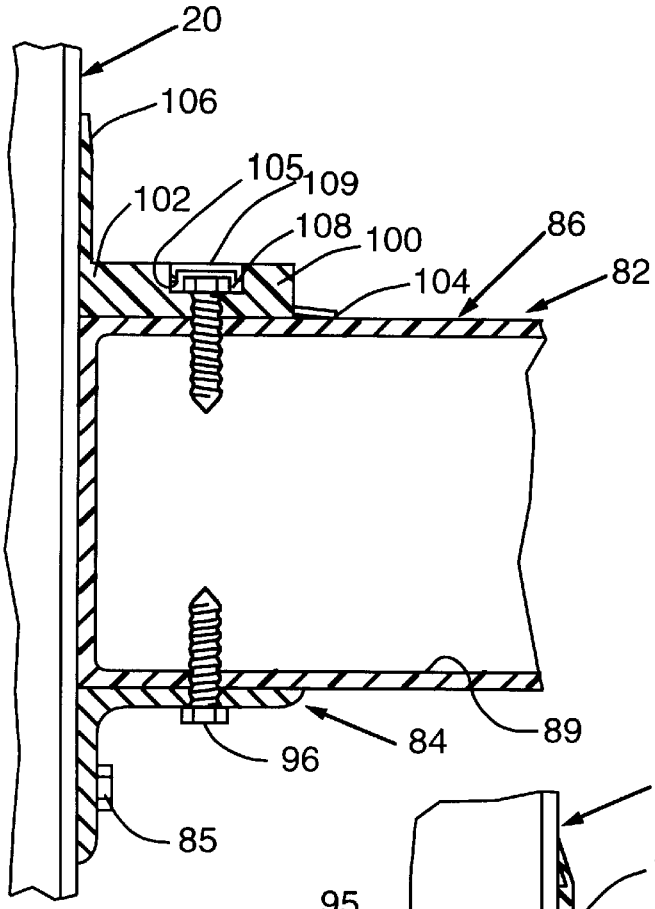
FIG. 13 is another partial cross-sectional elevational view of a shelf attached to a wall of a mausoleum.
Figure 14:
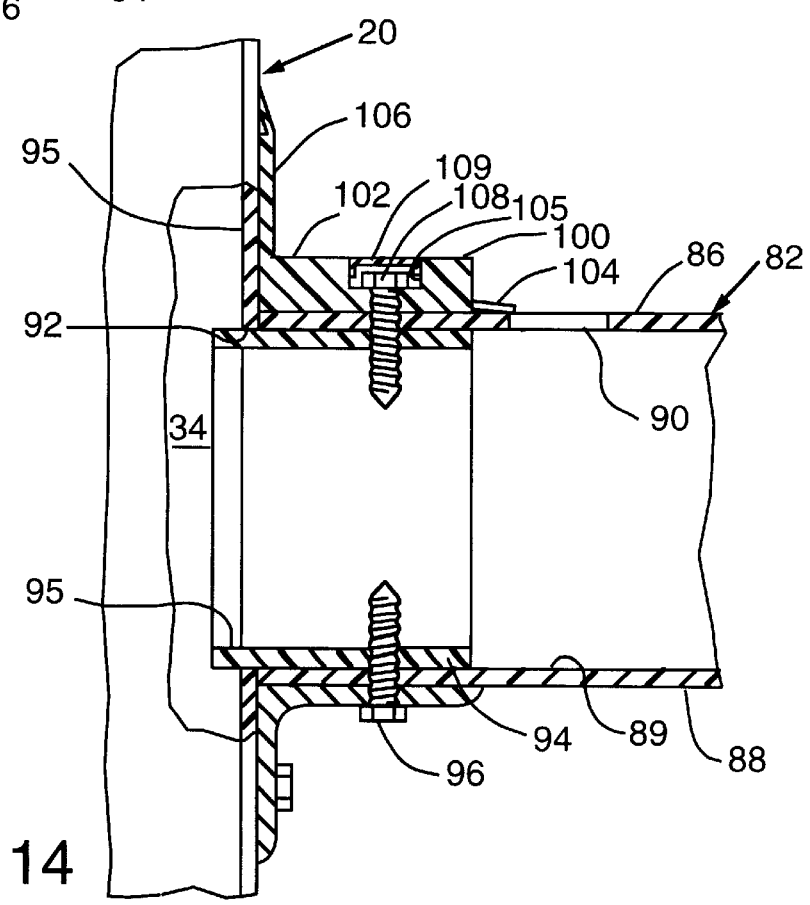
FIG. 14 is another partial cross-sectional elevational view of the shelf and wall of FIG. 13 illustrating a connector for creating a vent/drainage passage from an open shelf cell into the open cell within the wall.

FIGS. 11–13 depict a preferred shelf 82. As can be seen in FIGS. 12 and 13, the shelf 82 is preferably extruded from a polymeric material and may have an upper surface 86 and a lower surface 88 and a plurality of open cell passageways 89 therebetween. If desired, one or more of the open cell passageways 89 can serve as drain/vent passages and the other cells may be filled with a filler material 32 such as, for example, concrete. As can be seen in FIG. 12, one or more openings 90 are provided through the upper surface 86 of the shelf 82 into the drain/vent passageways 89 integrally formed within the shelf 82. In a preferred embodiment, an opening 92 corresponding to each drain/vent passage 89 in the shelf 82 and open cell (24, 27, 35) is provided in the wall 20 forming the end of the mausoleum 10. See FIG. 14. A hollow connector 94 that is compatible with the corresponding shelf passageway 89 is used to provide a passage 95 from that passageway 89 into the corresponding open cell (24, 27, 34) in the end wall 20. Connector 94 may be affixed to shelf 82 and the wall 20 by commercially available adhesive. Other connector configurations may also be employed.

The shelf 82 may be attached to the support member 84 by conventional lag screws 96. In addition, a seal member 100 is attached around the upper perimeter of the shelf 82 to establish a substantially fluid-tight seal between the shelf 82 and the adjacent walls 20. The seal manufactured by Royal Building Systems under model no. TEBSLAATU may be successfully employed. As can be seen in FIGS. 12 and 13, seal member 100 has a body portion 102 that is attachable to the shelf 82 and has a first flexible wiper portion 104 that is configured for sealing engagement with the upper surface 86 of the shelf 82. The seal member 100 may also have an integrally formed upstanding member 106 that is adapted to sealingly engage an adjacent wall 20. The body portion 102 of the seal may have a groove 105 therein that is adapted to receive the heads of lag screws 108 or the like that are employed to affix the seal to the shelf 82. A dress cap 109 may be snapped into the groove 105 to cover the heads of the screws 108. See FIGS. 12 and 13.

The skilled artisan will readily appreciate that such shelf arrangement represents a vast improvement over prior shelves employed in mausoleum structures. In this embodiment, the shelves 82 serve to define substantially fluid-tight chambers 42 within the niches 40 formed by the interconnected walls 20. Each shelf 82 can also serve as a drain/vent passage/collector that substantially extends for the length of the chamber 42. In addition, the polymeric material from which the shelf 82 is preferably constructed, serves to reduce the friction between the upper surface 86 of the shelf 82 and the casket. Thus, if desired, a casket may be slid on the shelf 82 into the chamber 42 without the use of rollers.

Figure 15:
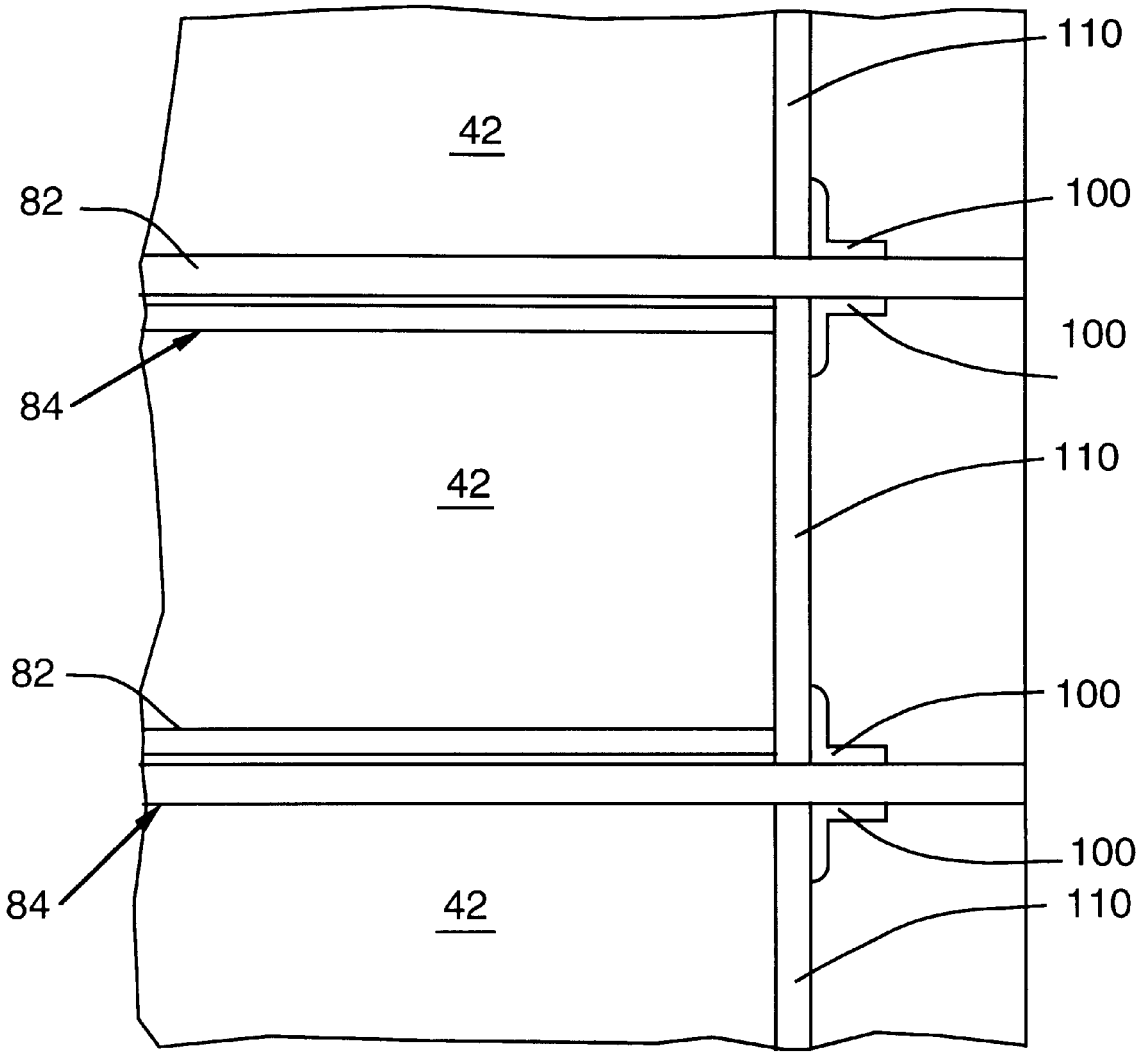
FIG. 15 is a partial cross-sectional elevational view of a portion of the mausoleum of FIG. 1 showing the closure panels covering the openings of three corresponding "stacked" chamber
Figure 16:
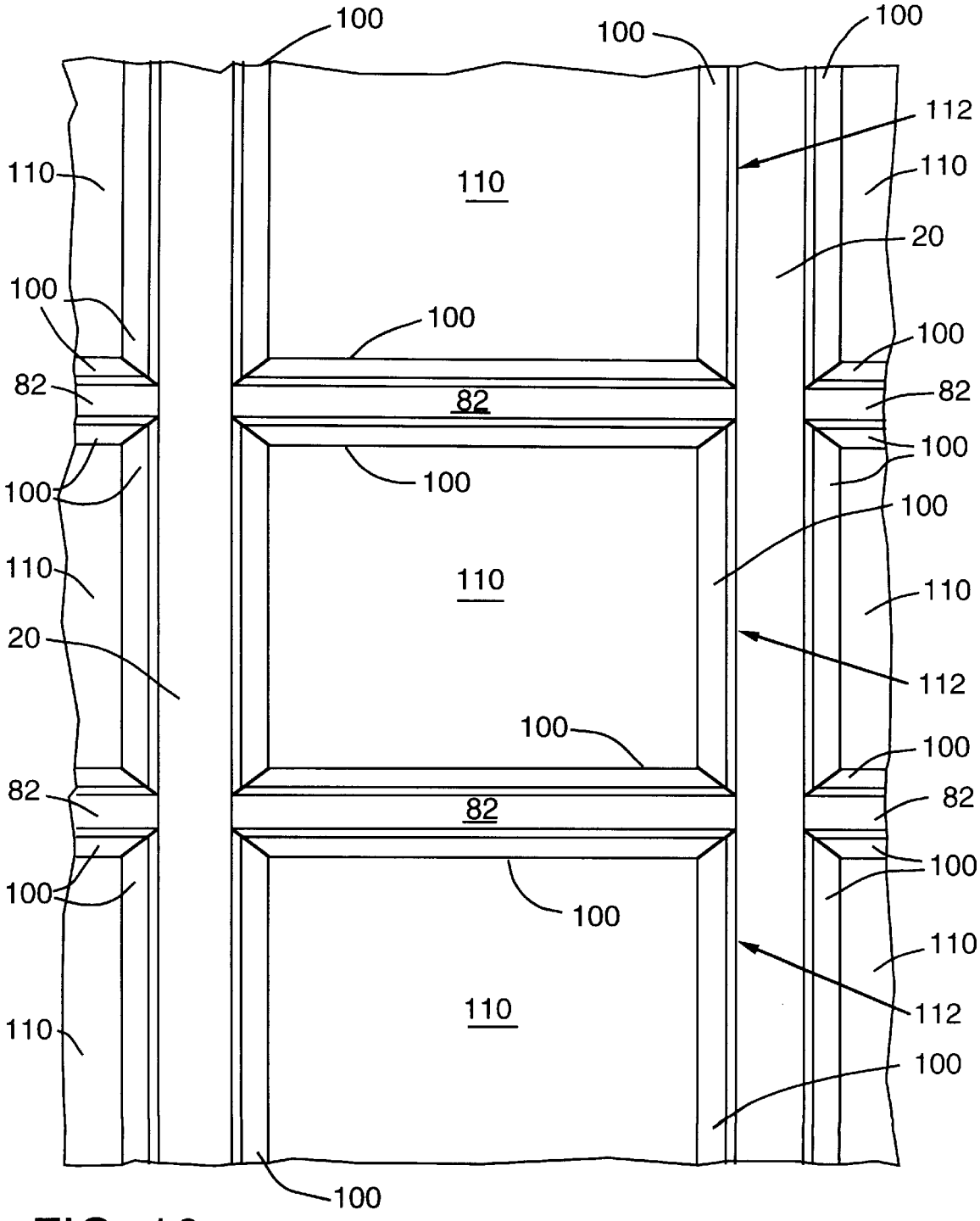
FIG. 16 is a partial front elevational view of the mausoleum and closure panels of FIG. 15.

FIGS. 15 and 16 depict a closure panel 110 designed to enclose the open end of a corresponding chamber 42 to make the corresponding chamber 42 substantially fluid-tight after a casket has been placed therein. Closure panel 110 may be fabricated from a polymer material such as vinyl and is sized to be received in the open end of the chamber 42 as shown in FIGS. 15 and 16. If desired, the closure panel may have a plurality of open cells therein that may be filled with concrete for security purposes. However, the closure panels 110 may be fabricated from other suitable materials. The closure panel 110 may then be removably retained in position by a frame 112 constructed of seal members 100 described above. The frame 112 may be attached to the closure panel and to the shelves and lateral walls by mechanical fasteners, such as screws, etc. If desired, commercially available marble or granite material may be affixed to the front end of the mausoleum using known fastening techniques.

Figure 17:
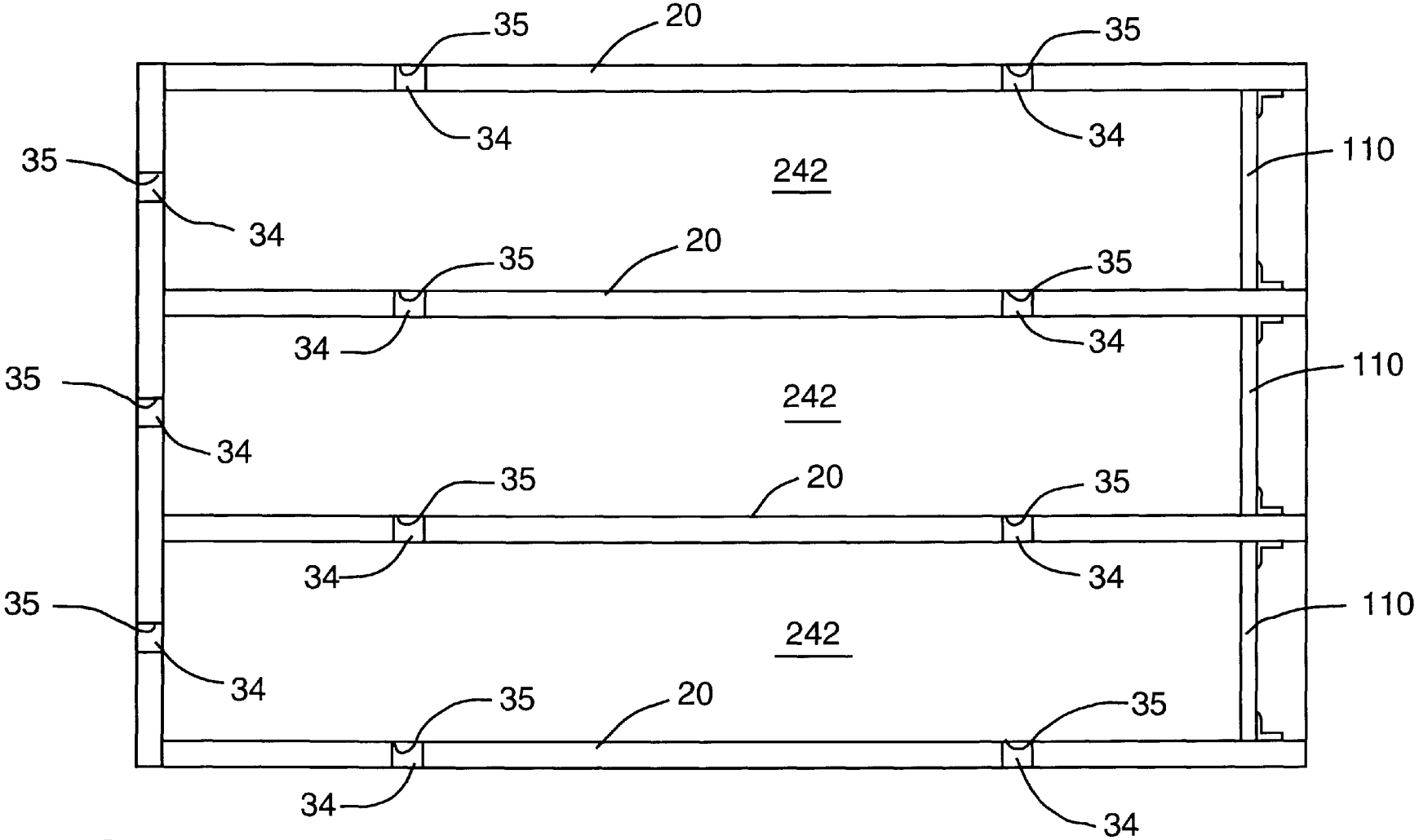
FIG. 17 is a plan view of another mausoleum configuration of the present invention.

Those of ordinary skill in the art will appreciate that the wall structures, shelves and construction methods described above can be used to construct a variety of different mausoleums and underground crypts. For example, the subject invention can comprise an end-to-end crypt 210 as shown in FIG. 17. Such configuration may employ the shelf assemblies 80 described above to define a plurality of back-to-back chambers 242 wherein two caskets may be placed in end-to-end fashion. A removable closure panel 110 of the type described above may be employed to enclose the open ends of the chambers 242. In this embodiment, the lateral walls may be 4" wide and may be spaced 2'-8¼" from each other; each chamber may be 14'- 11½" long. Also in this embodiment, vent and drain passages 34 formed by open cells 35 in the walls 20 are preferably provided in the orientation illustrated in FIG. 16 to provide each chamber 242 with venting and drainage, adjacent to each casket housed therein.

Figure 18:
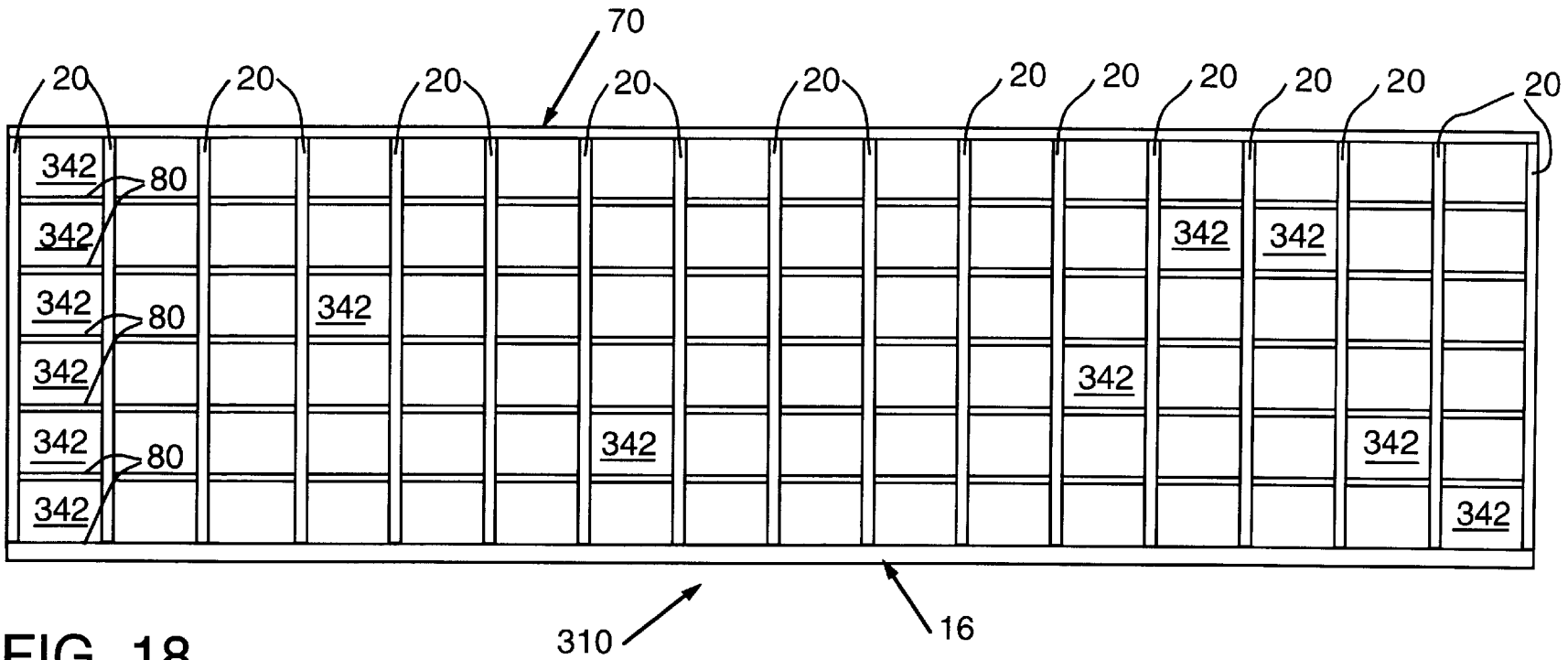
FIG. 18 is a front elevational view of another mausoleum construction of the present invention with the closure panels thereof removed.
Figure 19:
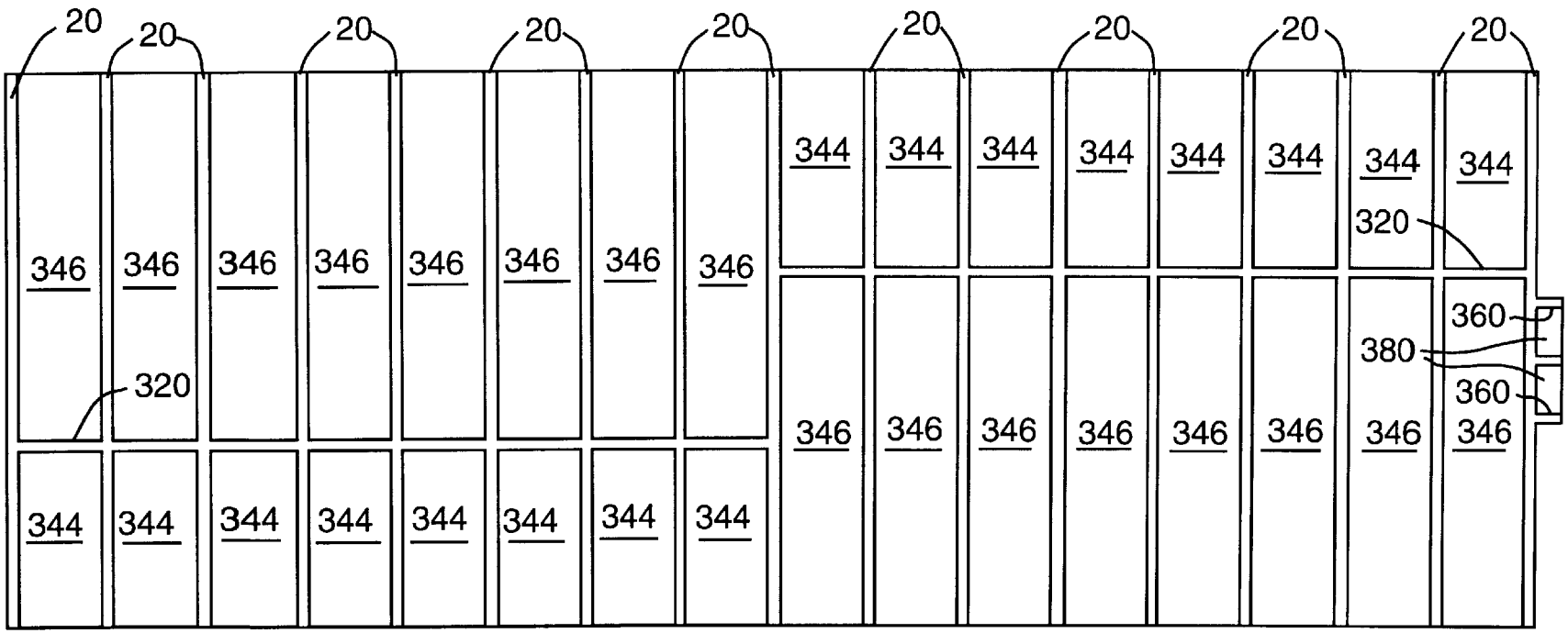
FIG. 19 is a plan view of the mausoleum of FIG. 18.
Figure 20:
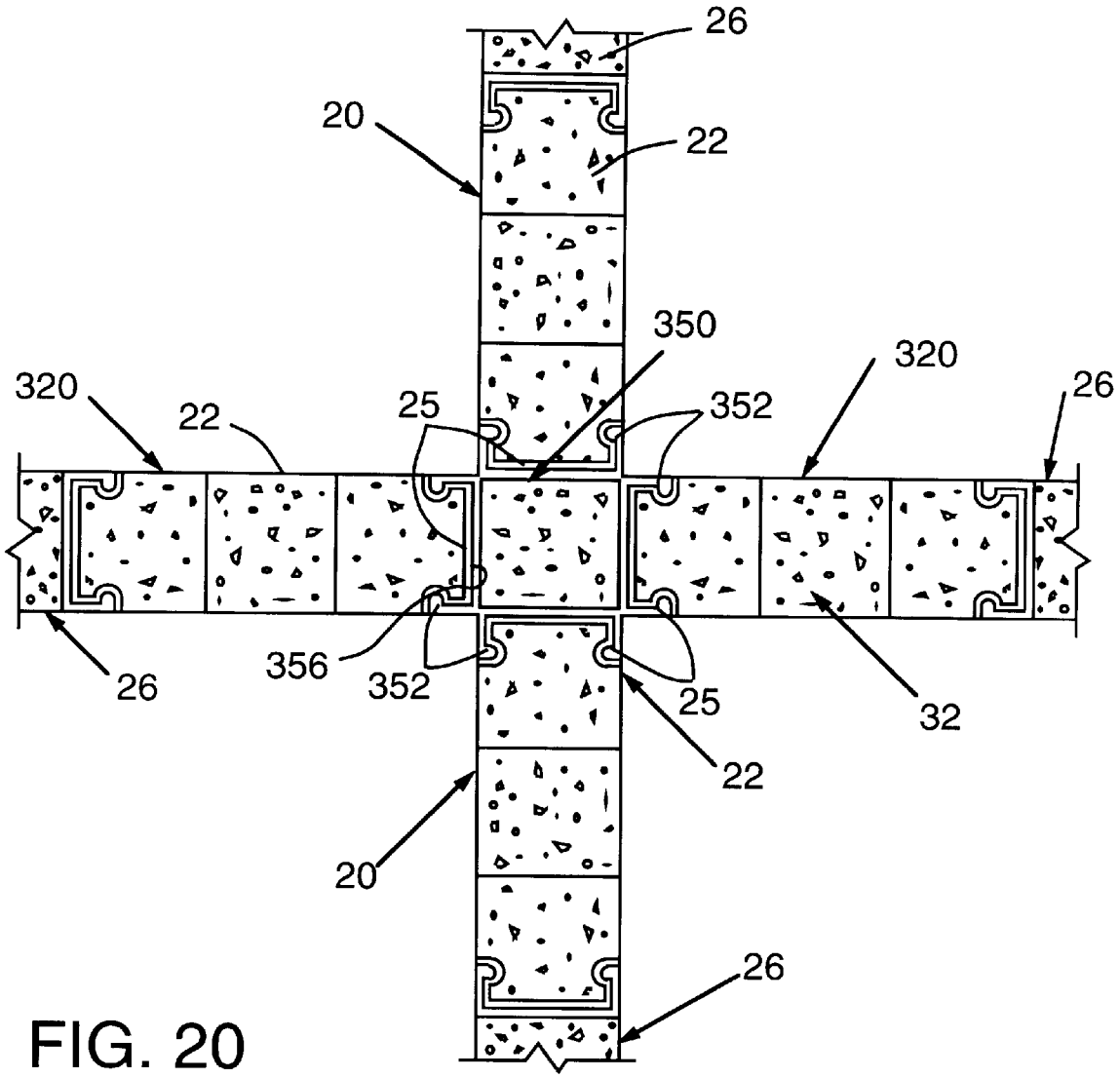
FIG. 20 is a partial cross-sectional plan view of a four way connector panel interconnecting walls and separator walls of the mausoleum depicted in FIGS. 18 and 19.

FIGS. 18 and 19 also depict yet another mausoleum configuration that may be constructed utilizing the materials and methods described above. In this embodiment, a collection of walls 20 of the type and construction described above are supported on a base member 16 to create a mausoleum 310 having a total of 288 chambers 342. In this embodiment, separator walls 320 are used to define subniches, such as a first niche 344 that is configured to accept one casket (i.e., is approximately 7'-5¾" long) and a second niche 346 that is configured to accept two, end-to-end caskets (i.e., 14'-11½" long). See FIG. 19. The separator walls 320 may be fabricated from a plurality of wall panels 22 described above and may each have an open cell panel 35 integrally received therein which corresponds to each niche that the separator wall spans. The T-connection arrangement shown in FIG. 8 is preferably employed wherein each separator wall 320 engages a corresponding outermost wall 20 which forms a side of the mausoleum 310. A preferred intersection arrangement between the separator walls 320 and the interior walls 20 is depicted in FIG. 20. As can be seen in that Figure, the walls 20 may comprise those wall panels 22, connector panels 26, open cell panels 35 and box connectors 37 described above and the separator walls 320 may be fabricated from an arrangement of similar elements. A four-way box connector 350 is affixed to the adjoining separator walls 320 and walls 20 as shown. The four way box connector fabricated by Royal Building Systems under model no. GEBCXUHATS1660F may be used. Preferably the box connector 350 has four C-shaped connector portions 352 that are adapted to slidably receive corresponding T-shaped connectors of the adjoining walls 20 and 320 such that the walls (20, 320) are interlocked together as shown. Also, the box connector preferably defines a cell 356 that can also receive a filler material therein. In a preferred embodiment, the adjoining wall panel cells (24, 27)and the cell 356 are filled with a filler material 32, such as concrete.

Also in this embodiment, a roof structure 70 as described above may be employed. However, any roof configuration may be employed as desired. In addition, shelf assemblies 80 of the type and construction described above may be employed to subdivide each niche (344, 346) into 6 chambers 342 as shown in FIG. 18. Each chamber 342 may be approximately 2'-2" high×2'-8¼" wide. To achieve appropriate draining and venting of each chamber 342, at least one, and preferably both, walls 20 that correspond to and form the sides of each chamber 342 have at least one open cell panel 35 therein to function as a drain/vent passage 34 for that chamber 342 and, if desired, the chambers 342 thereunder. For those chambers 342 sized to receive two caskets in end-to-end fashion, at least one drain/vent passage 34 is preferably provided in the walls 20 adjacent to each casket position.

Figure 21:
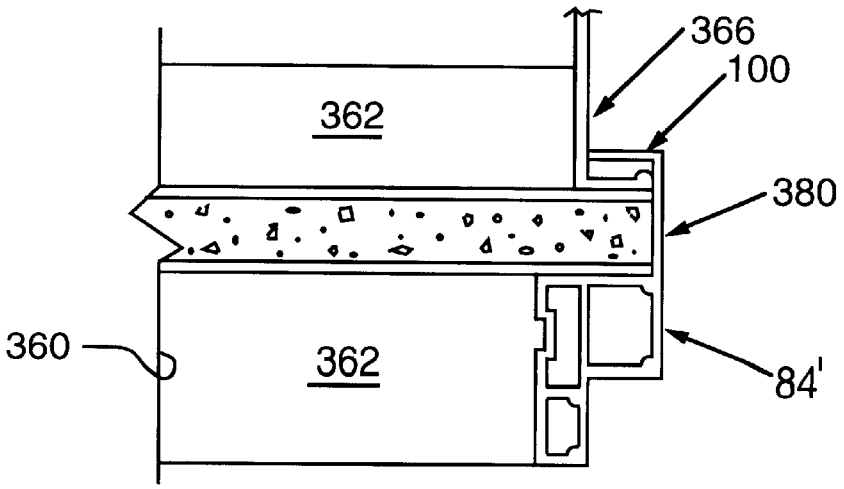
FIG. 21 is a partial cross-sectional view of a portion of the mausoleum of FIGS. 18 and 19 illustrating the construction of small niches on a side of the mausoleum.

If desired, smaller niches 360 may be constructed as shown in FIG. 19 on an outside wall 20. To form such smaller niches 360, the three-way box connector described above may be employed between the panels 22 forming the outside wall 20 to define the smaller niches 360 that may be approximately 2'-1⁹⁄₁₆" wide. In the alternative, such niches may be 8"×8"×8". A plurality of shelf segments 380 may attached as shown in FIG. 21, to form a plurality of sub-chambers 362. To support each shelf segment 380, casing material 84' may be used. The opening of each sub-chamber 362 may be enclosed by the closure panel of the type and construction described above.

Figure 22:
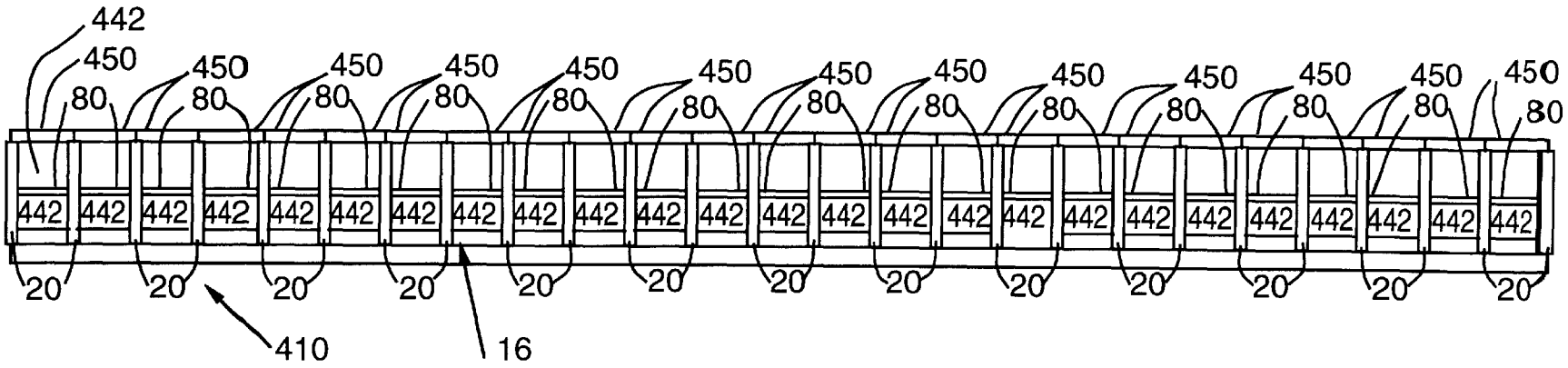
FIG. 22 is a front elevational view of a lawn crypt of the present invention.
Figure 23:
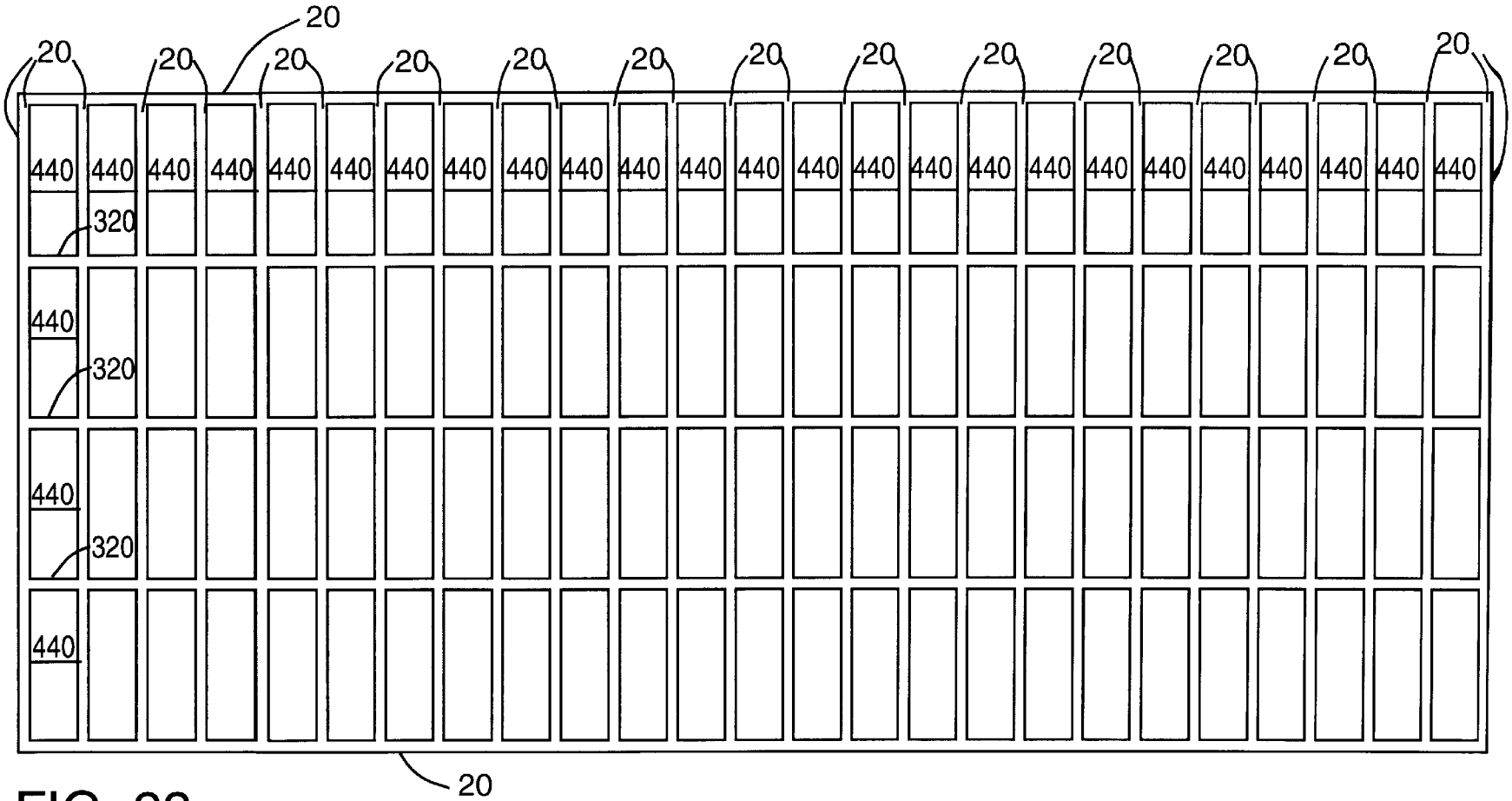
FIG. 23 is a plan view of the lawn crypt of FIG. 22 with the lids thereof removed.

The subject invention may also comprise a lawn crypt 410 that is fabricated from the materials described above. As can be seen in FIGS. 22 and 23, walls 20 and separator walls 320 of the types described above, may be supported on a base member 16 to define a total of one hundred niches 440. To construct the lawn crypt 410, an excavation of sufficient size to support the lawn crypt 410 is made in the earth. Thereafter, the base member 16, preferably in the form of an 8" concrete slab, is installed within the excavation. Thereafter, the lateral walls 20 and separator walls 320 are erected in the manner described above. Preferably, a shelf assembly 80 of the type described above is supported within each niche 440 to form a double-tier lawn crypt having two hundred chambers 442. Because the lawn crypt 410 is underground, it is not necessary to vent/drain each individual chamber 442. However, if desired, each chamber 442 could be drained/vented in the manners described above. Each upper chamber 442 may be sealed with a corresponding concrete lid 450.

After the lawn crypt 410 has been constructed, the lids 450 are placed onto their corresponding chambers 442 and the entire crypt 410 is then covered with soil. When access to a niche 440 is desired, the portion of soil covering the niche's lid 450 is removed to expose the lid. The lid 450 is removed and the casket is placed into the niche 440. Thereafter, a shelf assembly 80 is affixed within the niche 440 to enclose the casket in a lower chamber 442. The lid 450 is then replaced and the soil is regraded thereover. When it is desired to access the upper chamber 442 of that particular niche 440, the soil is removed from atop the corresponding lid 450 to enable the lid 450 to be removed. The casket is then placed into the upper chamber 442 and the lid 450 is replaced. Again the soil is placed over the lid 450. That process may then be repeated until the lawn crypt 410 is filled with caskets.

From the forgoing description, it will be appreciated that the present invention may be used to constructed a variety of different mausoleum and lawn crypt structures having a variety of different capacities. Thus the scope of protection afforded to the present inventions herein should not be limited only to the specific mausoleum and lawn crypt configurations herein described.

Furthermore, the wall assembly and roof structures have been described herein as being fabricated from components manufactured by Royal Building Systems. Those of ordinary skill in the art will appreciate that the present invention may be fabricated from other components that provide those structures with similar properties and functions. Therefore, the scope of protection afforded to the subject invention should not be limited to use of Royal Building Systems. Likewise, the inventions described herein may include lateral walls, end walls and separator walls fabricated utilizing interconnectable wall panels. Those of ordinary skill in the art will readily appreciate that such walls and roof structure disclosed herein may be fabricated as a unitary structure. That is, the open cells may be integrally formed in one wall segment and not in separate wall panels that are interlockingly affixed together to form a wall segment. In addition, when constructing above-ground mausoleums, only one lateral wall, end wall or separator wall that corresponds to a collection of interior chambers need be fabricated with the appropriate number of integrally formed open cells therein to facilitate draining and venting of the corresponding chambers. For example, the present invention may be practiced to form a mausoleum wherein the common end wall or common separator wall is fabricated as described above and all of the lateral walls and roof structure connected thereto may be fabricated using conventional methods (i.e., those walls may be precasted concrete).

Those of ordinary skill in the art will also appreciate that the cells of the panels can conceivable be filled with suitable filler material other than concrete. For example, those cells that do not have to engage or support a connector such as a lag screw or the like, could be filled with a material such as sand, etc. However, where an element such as a closure panel seal, shelf support, shelf seal must be attached to the wall, it is advantageous to use a filler material in at least some corresponding cells that can support an appropriate fastening member. The skilled artisan will further appreciate that by employing open cell panels that are integrally formed in the walls in interlocking engagement with the wall panels thereof, the damaged encountered by prior construction methods may be avoided.

Thus, from the foregoing discussion, it is apparent that the present invention solves many of the problems encountered when constructing prior mausoleums and lawn crypts. It is estimated that the present inventions can be constructed in approximately one half the time that is normally required to construct such structures using conventional methods and materials. The unique and novel method of utilizing open cells that are integrally formed and interlocked within a wall structure that is fabricated from a single material eliminates the risk of such passage becoming damaged during the forming of the wall as is often the case in conventionally constructed walls. The materials used in the present invention are also relatively lightweight and lend themselves to being easily shipped to the construction sites, unlike conventional precast concrete walls. Furthermore, the exterior and interior surfaces of the walls can be provided with a relatively smooth texture that is easy to clean and aesthetically pleasing. The wall panels may also be provided in a variety of different colors to suit the desired architectural scheme for the structure. If desired, the outer surface of the above-ground structure may be covered with marble facing using conventional fastening techniques. While such characteristics of the present invention represent some of the vast improvements over prior mausoleums and lawn crypts, those of ordinary skill in the art will, of course, appreciate that various changes in the details, materials and arrangement of parts which have been herein described and illustrated in order to explain the nature of the invention may be made by the skilled artisan within the principle and scope of the invention as expressed in the appended claims.

What is claimed is:

1. A mausoleum comprising:

a plurality of vertically extending walls supportable on a surface, at least one said vertically extending wall having a plurality of cells integrally formed therein;

a roof supported on said plurality of vertically extending walls and cooperating therewith to define at least one crypt niche having at least one open end; and a closure panel corresponding to each said open end of each said crypt niche, each said closure panel being removably attachable to said mausoleum to cover said corresponding open end.

2. The mausoleum of claim 1 wherein at least one said cell in at least one said vertically extending wall is substantially filled with a filler material.

3. The mausoleum of claim 2 wherein said filler material comprises concrete.

4. The mausoleum of claim 1 wherein at least one said cell forms an open passageway from at least one said crypt niche through the exterior of said mausoleum.

5. The mausoleum of claim 1 wherein at least one said vertically extending wall has at least two adjacent cells therein that are filled with a filler material and wherein at least one baffle opening is integrally formed between said adjacent cells to permit said filler material to extend between said adjacent cells.

6. The mausoleum of claim 1 wherein each said vertically extending wall that has plurality of cells therein comprises at least two interlocking wall panels.

7. The mausoleum of claim 6 wherein each said vertically interlocking wall panel is fabricated from a polymeric material.

8. The mausoleum of claim 6 wherein at least one said interlocking wall panel has a first connector portion configured to slidably engage a second connector portion of an adjacent wall panel.

9. The mausoleum of claim 8 wherein said first connector portion is T-shaped and wherein said second connector portion comprises an elongated C-shaped cavity sized to receive a corresponding T-shaped first connector portion therein.

10. The mausoleum of claim 8 wherein each said interlocking wall panel is fabricated from a polymeric material.

11. The mausoleum of claim 1 wherein said roof member comprises a plurality of interlocked wall panels attached to said vertically extending walls.

12. The mausoleum of claim 1 wherein said vertically extending walls are supported on and attached to a concrete slab and wherein each said cell forming said passageway communicates with an exterior drain adjacent said concrete slab.

13. The mausoleum of claim 12 further comprising a roof vent assembly attached to each said cell forming said passageway.

14. The mausoleum of claim 1 wherein each said closure panel further comprises a seal attached to a perimeter of said closure panel for establishing a substantially fluid-tight seal between said closure panel and said vertically extending walls.

15. The mausoleum of claim 1 further comprising at least one shelf supported within at least one said crypt niche.

16. The mausoleum of claim 15 wherein said shelf includes a drain conduit communicating with at least one said cell forming said passageway.

17. The mausoleum of claim 16 wherein said shelf has a support surface and at least one shelf cell integrally formed therein and wherein one said shelf cell comprises said drain conduit, said support surface having an opening therethrough into said shelf cell comprising said drain conduit.

18. The mausoleum of claim 15 wherein said shelf has a plurality of open shelf cells therein and wherein at least one said open shelf cell is filled with a filler material.

19. The mausoleum of claim 15 wherein said shelf is fabricated from a polymeric material.

20. The mausoleum of claim 15 wherein each said shelf cooperates with two said vertically extending walls and one of said roof member and another said shelf to form chambers within each said niche in which said shelves are supported, each said chamber being at least 2'-2" high and 2'-2" wide.

21. The mausoleum of claim 15 further comprising a shelf seal extending around a perimeter of said shelf to establish a substantially fluid-tight seal between said shelf and said vertically extending walls.

22. The mausoleum of claim 1 wherein at least one said niche is substantially fluid-tight when said closure panels cover each said open end thereof.

23. The mausoleum of claim 1 further comprising at least one decorative panel affixed to at least one of said vertically extending walls and said closure panel.

24. A mausoleum, comprising:

a base slab;

at least two vertically extending walls supported on said base slab, at least one said vertically extending wall having a at least one substantially unobstructed cell integrally formed therein;

a roof member supported on said vertically extending walls to form at least one crypt niche having at least one open end;

at least one shelf member supported within each said crypt niche to subdivide said crypt niche into a plurality of chambers wherein each said chamber has an open end, each said shelf having at least one drain conduit communicating with said unobstructed cell in at least one said vertically extending wall;

a closure panel corresponding to each said open end of each said chamber and being removably attachable to said mausoleum to enclose said corresponding open end.

25. The mausoleum of claim 24 wherein at least one said cell in at least one said vertically extending wall is substantially filled with a filler material.

26. The mausoleum of claim 24 wherein each said shelf has a support surface and a plurality of shelf cells integrally formed therein, wherein at least one said shelf cell comprises said drain conduit and wherein said support surface has at least one opening therethrough into said shelf cells comprising said drain conduit.

27. The mausoleum of claim 24 further comprising at least one vertically extending separator wall extending between at least two said vertically extending walls to further divide said chambers in a lengthwise direction.

28. The mausoleum of claim 27 wherein at least one said vertically extending separator wall interlocks with said vertically extending walls between which said vertically extending separator wall extends.

29. The mausoleum of claim 28 wherein each said interlocking vertically extending separator wall has two lateral sides, each said lateral side having a T-shaped connector portion integrally formed therein adapted to be received in correspondingly-shaped receptacle portions integrally formed in said vertically extending walls.

30. The mausoleum of claim 24 wherein each said chamber has a volume and wherein all said volumes of said chambers are substantially equal.

31. The mausoleum of claim 24 wherein each said chamber has a volume and wherein the volume of one said chamber differs from said volume of another said chamber.

32. The mausoleum of claim 24 wherein each said chamber is at least 2'-2" wide, 2'-2", high and 7'-5" deep.

33. The mausoleum of claim 24 wherein at least one said chamber is at least 8" wide, 8" high and 8" deep.

34. The mausoleum of claim 24 further comprising at least one decorative panel affixed to at least one of said vertically extending walls and said closure panel.

35. A combination shelf assembly and wall arrangement for a crypt niche, said combination comprising:

at least one niche wall having at least one passage therein;

a support frame attachable to at least one said niche wall;

a shelf supportable on said support frame, said shelf having a plurality of open cells formed therein; and a hollow connector extending between one said open cell and at least one said passage in said at least one niche wall to establish a passageway therebetween.

36. The shelf assembly of claim 35 wherein said shelf is fabricated from a polymeric material.

37. The shelf assembly of claim 35 wherein said shelf has an upper surface and said upper surface has at least one opening therethrough into said open cell having said hollow connector extending between said open cell and at least one said passage.

38. The shelf assembly of claim 35 further comprising a seal extending around the perimeter of said shelf to form a seal between said shelf and at least the niche walls adjacent thereto.

39. The shelf assembly of claim 38 wherein said seal comprises:

a body portion attachable to said shelf and having a first flexible wiper portion for sealing engagement with a support surface of said shelf; and an upstanding member adapted to sealingly engage an adjacent niche wall.

40. The shelf assembly of claim 39 wherein said body portion has an attachment cavity therein and wherein said body portion is attached to said shelf by fasteners, a portion of each said fastener received within said attachment cavity and wherein said shelf assembly includes a finish strip received in said attachment cavity to cover said portion of said fasteners received within said attachment cavity.

41. A lawn crypt, comprising:

a base member;

a plurality of vertically extending walls attached to said base member, at least one said vertically extending wall having a plurality of cells integrally formed therein, wherein at least one said cell is substantially filled with a filler material and wherein at least one other said cell is open; and a removable lid received on said vertical walls to cover at least one said crypt niche.

42. The lawn crypt of claim 41 further comprising at least one shelf member supported within each said crypt niche to subdivide said crypt niche into a plurality of stacked chambers.

43. The lawn crypt of claim 41 wherein at least one said vertically extending wall is fabricated from a polymeric material.

44. A method of constructing a mausoleum, comprising:

constructing a base;

supporting at least two upstanding walls on said base, wherein at least one said upstanding wall has a plurality of open cells integrally formed therein;

supporting a roof on said upstanding walls to form a crypt niche having an interior and at least one open end; and enclosing each said open end with a removable closure panel to substantially enclose said crypt niche.

45. The method of claim 44 further comprising substantially filling at least one said open cell in at least one said upstanding wall having open cells therein with a filler material.

46. The method of claim 45 wherein at least one said open cell in at least one said upstanding wall is unfilled and forms a passageway from said crypt niche interior through the crypt exterior.

47. The method of claim 46 further comprising attaching each said unfilled open cell that forms said passageway to an external drain.

48. The method of claim 46 further comprising venting each said passageway.

49. The method of claim 45 wherein said base comprises a concrete slab and wherein said filler material comprises concrete.

50. The method of claim 44 further comprising supporting at least one shelf within said crypt niche interior.

51. The method of claim 50 establishing a substantially fluid-tight seal between each said shelf and the corresponding upstanding walls and each said corresponding removable closure panel.

52. The method of claim 44 further comprising interlocking two wall panel sections to form each said upstanding wall section having at least one open cell therein.

53. The method of claim 52 wherein each said upstanding wall section has two lateral edges and wherein said method further comprises interlocking at least one said lateral edge of at least one upstanding wall with a corresponding lateral edge of at least one other said upstanding wall.

54. The method of claim 44 further comprising attaching at least one decorative panel affixed to at least one of said upstanding walls and said closure panel.

55. A method of constructing a lawn crypt, comprising:

excavating a cavity in the earth;

constructing a concrete support base within said cavity;

supporting at least two lateral walls on said concrete support base in spaced-apart relation to each other, wherein at least one said lateral wall has a plurality of open cells extending the length thereof and wherein each said lateral wall has first and second ends;

attaching a first end wall having a plurality of open cells therein to said first ends of said lateral walls such that said first end wall is supported on said support base and extends between said lateral walls;

substantially filling at least two said open cells in said first end wall and at least one said open cell in each of said lateral walls to interlock said first end wall to said lateral walls;

attaching a second end wall having a plurality of open cells therein to said second ends of said lateral walls such that said second end wall is supported on said base and extends between said lateral walls, said lateral walls and said first and second end walls defining at least one crypt niche therebetween;

substantially filling at least one other said open cells in each of said lateral walls and at least two said open cells in said second end wall to interlock said second end wall to said lateral walls; and covering each crypt niche with a removable lid.

56. The method of claim 55 further comprising supporting a shelf in each said niche.

57. The method of claim 55 further comprising supporting at least one cross wall on said support base between two said lateral walls to form a plurality of niches between said least lateral walls.

58. The method of claim 57 further comprising supporting a shelf in each said niche.

59. The method of claim 57 wherein each said cross wall is interlocked to said lateral walls between which it extends.

60. The method of claim 55 wherein said first and second end walls each have a plurality of cavities integrally formed therein and wherein said method comprises substantially filling at least one said cavity in each said first and second end walls with concrete.

61. A method of constructing a mausoleum, comprising:

constructing a support base;

constructing a plurality of permanent forms on said support base, each said form having a substantially hollow interior;

substantially filling said substantially hollow interior of at least one said permanent form with a filler material such that said forms define interior and exterior wall surfaces;

supporting a roof on said permanent forms to form a crypt niche having at least one open end; and enclosing each said open end with a closure panel.

62. The method of claim 61 further comprising attaching at least one decorative panel to at least one of said exterior wall surfaces and said closure panel.

* * * * *